US009545158B2

(12) United States Patent
Goldberg

(10) Patent No.: US 9,545,158 B2
(45) Date of Patent: Jan. 17, 2017

(54) PROTECTIVE BARRIER FOR A ZIPPER ASSEMBLY

(75) Inventor: Gary Goldberg, Barrington, RI (US)

(73) Assignee: CleanBrands, LLC, Warwick, RI (US)

( * ) Notice: Subject to any disclaimer, the term of this patent is extended or adjusted under 35 U.S.C. 154(b) by 668 days.

(21) Appl. No.: 13/494,250

(22) Filed: Jun. 12, 2012

(65) Prior Publication Data

US 2012/0311785 A1 Dec. 13, 2012

Related U.S. Application Data

(60) Provisional application No. 61/496,473, filed on Jun. 13, 2011, provisional application No. 61/536,408, filed on Sep. 19, 2011.

(51) Int. Cl.

| | |
|---|---|
| ***A44B 19/24*** | (2006.01) |
| ***A47C 31/00*** | (2006.01) |
| ***A47C 31/10*** | (2006.01) |
| ***A47G 9/02*** | (2006.01) |
| *A47G 9/00* | (2006.01) |

(52) U.S. Cl.

CPC ..... *A47C 31/007* (2013.01); *A47C 31/105* (2013.01); *A47G 9/0253* (2013.01); *A47G 2009/001* (2013.01); *Y10T 24/2514* (2015.01)

(58) Field of Classification Search

CPC ..... A47C 31/007; A47C 31/105; A44B 19/32; A44B 19/262; A44B 19/265; A44B 19/303; A44B 19/301; A44B 19/30; A44B 19/305; A47G 2009/001

USPC ..... 24/433, 436, 388, 403, 498, 389; 5/699, 5/738, 499, 501

See application file for complete search history.

(56) References Cited

U.S. PATENT DOCUMENTS

| | | | | |
|---|---|---|---|---|
| 1,506,286 | A * | 8/1924 | Binns | 24/419 |
| 2,119,621 | A * | 6/1938 | Ferrone | 2/96 |
| 2,190,608 | A * | 2/1940 | Poux | 24/388 |
| 2,264,085 | A | 11/1941 | Loos | |

(Continued)

FOREIGN PATENT DOCUMENTS

| | | |
|---|---|---|
| CN | 1939180 A | 4/2007 |
| CN | 201091425 Y | 7/2008 |

(Continued)

OTHER PUBLICATIONS

Espacenet—CN 201839825 U.*

(Continued)

*Primary Examiner* — Robert J Sandy
*Assistant Examiner* — Jason W San
(74) *Attorney, Agent, or Firm* — Wolf, Greenfield & Sacks, P.C.

(57) ABSTRACT

Protective assemblies for zippers described may include a protective barrier for preventing migration of particles and/or organisms between opposite surfaces of the barrier. When a zipper assembly is brought to a closed position, a zipper slider may form a connection with the barrier resulting in an obstruction to block infiltration of small particles or organisms (e.g., bed bugs, allergens, dust mites, small particles, etc.). The barrier may be attached to an article, such as a padded material for use with a bedding/furniture cover. In some embodiments, a cover may be implemented to enclose a portion of the zipper slider. The barrier may include one or more padding materials for preventing migration of small particles or organisms past obstructions formed by the padding material(s).

25 Claims, 15 Drawing Sheets

(56) References Cited

U.S. PATENT DOCUMENTS

| | | | | |
|---|---|---|---|---|
| 2,400,731 | A * | 5/1946 | Armstrong | 5/500 |
| 2,422,249 | A * | 6/1947 | Malluk | 36/50.1 |
| 2,477,563 | A * | 8/1949 | Angus | 150/157 |
| 2,494,249 | A * | 1/1950 | Krupp | 24/389 |
| 2,496,878 | A * | 2/1950 | Krupp | 24/389 |
| 2,907,055 | A | 10/1959 | Berman | |
| 3,005,247 | A * | 10/1961 | Doelter | 24/389 |
| 3,070,986 | A * | 1/1963 | Hart | 70/68 |
| 3,138,842 | A * | 6/1964 | Arthur | 24/615 |
| 3,292,748 | A * | 12/1966 | Rifkin | 190/119 |
| 3,310,889 | A * | 3/1967 | Samuels | 36/72 R |
| 3,389,441 | A | 6/1968 | Heimberger | |
| 4,164,797 | A * | 8/1979 | Golembeck | 5/738 |
| 4,368,562 | A * | 1/1983 | Minami | 403/354 |
| 4,397,378 | A * | 8/1983 | Lee | 190/119 |
| 4,514,884 | A * | 5/1985 | Kaneko | 24/386 |
| 4,782,563 | A * | 11/1988 | Kusayama | 24/435 |
| 4,873,750 | A * | 10/1989 | Tracy | 24/429 |
| 4,976,121 | A * | 12/1990 | Wake | 70/68 |
| 5,065,602 | A * | 11/1991 | Williams et al. | 70/68 |
| 5,081,855 | A * | 1/1992 | Terada et al. | 70/68 |
| 5,177,884 | A * | 1/1993 | Rullier | 36/117.2 |
| 5,253,395 | A * | 10/1993 | Yano | 24/387 |
| 5,566,475 | A * | 10/1996 | Donnadieu | 36/55 |
| 6,363,553 | B1 | 4/2002 | Baumgärtel et al. | |
| 6,923,302 | B2 * | 8/2005 | Godshaw et al. | 190/109 |
| 6,948,207 | B2 | 9/2005 | Daly | |
| 7,428,789 | B2 * | 9/2008 | Holzer et al. | 36/88 |
| 7,552,489 | B2 | 6/2009 | Bell et al. | |
| 7,591,051 | B2 * | 9/2009 | Kusayama et al. | 24/387 |
| 7,735,615 | B2 | 6/2010 | Looram et al. | |
| 7,849,543 | B2 * | 12/2010 | Poston et al. | 5/699 |
| 8,087,111 | B2 * | 1/2012 | Paris | 5/499 |
| 8,307,480 | B2 * | 11/2012 | Tirpan | 5/699 |
| 8,375,528 | B2 * | 2/2013 | Takazawa et al. | 24/387 |
| 8,413,276 | B2 * | 4/2013 | Rattner et al. | 5/699 |
| 8,516,633 | B2 * | 8/2013 | Dobin | 5/499 |
| 2002/0070566 | A1 * | 6/2002 | Hudson | 292/315 |
| 2002/0116798 | A1 | 8/2002 | Okada et al. | |
| 2004/0020017 | A1 * | 2/2004 | Nedbal et al. | 24/429 |
| 2004/0250452 | A1 * | 12/2004 | Farys | 36/89 |
| 2005/0040559 | A1 * | 2/2005 | Yang | 264/275 |
| 2007/0067969 | A1 | 3/2007 | Kusayama et al. | |
| 2008/0250561 | A1 | 10/2008 | Poston | |
| 2009/0154844 | A1 | 6/2009 | Greenberg | |
| 2011/0023235 | A1 * | 2/2011 | Gold | 5/501 |
| 2011/0099714 | A1 * | 5/2011 | Svoboda | 5/499 |
| 2011/0126383 | A1 * | 6/2011 | Takazawa et al. | 24/389 |
| 2011/0162140 | A1 * | 7/2011 | Paris | 5/499 |
| 2012/0017402 | A1 * | 1/2012 | Feinberg | 24/387 |
| 2012/0084918 | A1 * | 4/2012 | Rattner et al. | 5/500 |
| 2012/0102646 | A1 * | 5/2012 | Chen et al. | 5/499 |
| 2012/0117728 | A1 * | 5/2012 | O'Neill | 5/499 |
| 2012/0167307 | A1 * | 7/2012 | Michael | 5/501 |
| 2012/0174347 | A1 * | 7/2012 | Higgins | 24/390 |
| 2012/0246890 | A1 * | 10/2012 | Hernandez | 24/436 |
| 2012/0260426 | A1 * | 10/2012 | Dobin | 5/499 |
| 2012/0324680 | A1 * | 12/2012 | Takazawa et al. | 24/389 |
| 2013/0117935 | A1 * | 5/2013 | Rensink et al. | 5/499 |
| 2013/0185841 | A1 * | 7/2013 | Berkowitz et al. | 2/69 |

FOREIGN PATENT DOCUMENTS

| | | | |
|---|---|---|---|
| CN | 201839825 U | * | 5/2011 |
| EP | 1 969 971 A1 | | 9/2008 |

OTHER PUBLICATIONS

International Search Report and Written Opinion for International Application No. PCT/US2012/042022 mailed Aug. 17, 2012.

Chinese Office Action issued Nov. 3, 2014 in connection with Chinese Application No. 201280039149.X, and English translation thereof.

Chinese Office Action issued Jul. 28, 2015 in connection with Chinese Application No. 201280039149.X, and English translation thereof.

Chinese Office Action issued Jan. 14, 2016 in connection with Chinese Application No. 201280039149.X, and English translation thereof.

Extended European Search Report for European Application No. 12801132.7 dated Feb. 11, 2015.

Extended European Search Report for European Application No. 15188735.3 dated Feb. 8, 2016.

International Preliminary Report on Patentability for International Application No. PCT/US2012/042022 mailed Jan. 3, 2014.

* cited by examiner

PROTECTIVE BARRIER FOR A ZIPPER ASSEMBLY

CROSS-REFERENCE TO RELATED APPLICTIONS

This application claims priority under 35 U.S.C. §119(e) to U.S. Provisional Application No. 61/496,473 filed Jun. 13, 2011 and U.S. Provisional Application No. 61/536,408 filed Sep. 19, 2011, both entitled "PROTECTIVE ZIPPER ASSEMBLY."

BACKGROUND

1. Field

The present disclosure relates to the use of a barrier with a zipper assembly. In some aspects, a barrier may be used with a zipper assembly to prevent the infiltration of small particles and/or organisms from one side of a barrier to an opposite side of the barrier.

2. Discussion of Related Art

Bed bugs are a type of small parasitic insect that prefers to feed on human blood and that can dwell within bed mattresses. To prevent bed bugs from reaching a person sleeping on a mattress, a fabric cover or encasement may be provided to surround the mattress so as to prevent the bugs from escaping. The encasement is typically placed around the mattress and closed by a zipper so that the bed bugs encounter the barrier of the fabric cover and are unable to exit.

Zippers are commonly used for temporarily joining two edges of material, typically fabric, for a wide range of daily applications, such as in the usage of clothing, luggage/bags, furniture and bedding materials. FIG. 1A depicts a conventional zipper assembly 10 having two strips of fabric tape 40 each affixed to corresponding zipper tracks 32, 34. The zipper tracks each have a number of teeth 36 that can be enmeshed together to form a set of linked zipper tracks 30. A zipper slider 20, having a Y-shaped channel, is manipulated by a user pulling a tab 22 to move the zipper slider along the rows of teeth so as to bring opposing rows of teeth together into a mesh, or to separate previously enmeshed teeth. Depending on the direction in which the slider is manipulated, the zipper can be opened or closed.

The zipper may be pulled in a direction (e.g., upward) so as to reach a closed position and such that the linked zipper tracks 30 may largely restrict the passage of small particles or organisms from one side of the zipper to the other. However, for standard zipper assemblies, even when closed, a small space (e.g., about 5 $mm^2$ in area) through which small particles or organisms might move will almost inevitably exist at the top of the zipper.

SUMMARY

The inventors have recognized that, when closing a zipper, no matter how tightly the zipper is pulled shut, a small hole will still remain between the zipper slider and the end of the zipper tracks. This hole will often provide a passageway through which small particles or organisms are able to infiltrate or escape from one side of the closed zipper to the other. Embodiments described herein relate to the appreciation that it would be beneficial to obstruct and/or block exit from such a passageway so as to limit the migration of small particles or organisms. Zipper assemblies are described in various embodiments herein, including those that utilize a protective barrier that may be used to prevent the migration of particles and/or organisms between opposite sides of the barrier when the zipper assembly is placed in a closed position.

Zipper assemblies in accordance with aspects of the present disclosure include a zipper slider for manipulating a pair of zipper tracks between open and closed positions of the zipper assembly and may be used with a protective barrier that is engageable with the zipper slider resulting in an obstruction that blocks migration of small particles and/or organisms through regions of the zipper assembly or from one side of the zipper or the barrier to another. In various embodiments, the barrier includes a body having a base surface that is attachable to an article, for example, a padding or bedding material (e.g., mattress/pillow cover) or bag/luggage, that is opened and closed by the zipper. The barrier may include a slider connecting region that is adapted to receive an appropriate connection portion of a zipper slider (e.g., a front piece of the zipper slider, other portions of the zipper slider, the zipper slider itself, etc.) upon closing of the zipper assembly. When the barrier and the zipper slider are suitably engaged or connected, an obstruction may be formed by the connection between the barrier and zipper slider, preventing the migration of small objects such as bed bugs, other organisms or particles from one surface of the barrier to an opposite surface of the barrier (e.g., between upper and lower regions of the barrier).

Barriers described herein may be used for embodiments involving articles for bedding arrangements (e.g., mattress/pillow covers, duvets, comforters, sleeping bags, etc.) or other padding materials that are opened and closed by a zipper. For instance, when closing the zipper assembly to form a suitable connection between the zipper slider and the barrier, due to the configuration provided by the zipper slider and barrier system, bed bugs may be prevented from migrating through the small opening that is commonly present in the zipper assembly between the zipper slider and the end of the zipper tracks.

In an illustrative embodiment, a barrier is provided. The barrier includes a base surface attachable to an article; and a slider connecting region adapted to receive a barrier connection portion of a zipper slider.

In another illustrative embodiment, a protective assembly for a zipper is provided. The protective assembly includes a pair of zipper tracks including a first plurality of teeth engageable with a second plurality of teeth; a zipper slider constructed and arranged with the pair of zipper tracks to manipulate the pair of zipper tracks between an open position and a closed position, the zipper slider including a barrier connection portion; and a barrier including a slider connecting region adapted to receive the barrier connection portion of the zipper slider upon placement of the pair of zipper tracks in the closed position so as to prevent migration of particles or organisms between a lower region and an upper region of the barrier.

In a further illustrative embodiment, a method of preventing particles or organisms from infiltrating through a protective assembly for a zipper including a pair of zipper tracks, a zipper slider, and a barrier. The method includes manipulating the zipper slider to bring a pair of zipper tracks toward a closed position; and engaging the zipper slider with the barrier by connecting a barrier connection portion of the zipper slider and a slider connecting region of the barrier so as to prevent migration of particles or organisms between a lower region and an upper region of the barrier.

In yet another illustrative embodiment, a protective assembly for a zipper is provided. The protective assembly includes a pair of zipper tracks including a first plurality of teeth engageable with a second plurality of teeth; a zipper slider constructed and arranged with the pair of zipper tracks to manipulate the pair of zipper tracks between an open position and a closed position; and a barrier including a slider connecting region adapted to receive a portion of the zipper slider upon placement of the pair of zipper tracks in the closed position so as to prevent migration of particles or organisms past a portion of the barrier.

In another illustrative embodiment, a method of preventing particles or organisms from infiltrating through a protective assembly for a zipper including a pair of zipper tracks, a zipper slider, and a barrier is provided. The method includes manipulating the zipper slider to bring a pair of zipper tracks toward a closed position; and engaging the zipper slider with the barrier by connecting a portion of the zipper slider and a slider connecting region of the barrier so as to prevent migration of particles or organisms past a portion of the barrier.

In a further illustrative embodiment, a barrier is provided. The barrier includes a base having a slider connecting region adapted to receive a portion of a zipper slider to form an obstruction that prevents migration of particles or organisms past a portion of the barrier.

In yet another illustrative embodiment, a barrier is provided. The barrier includes a base having a recess portion constructed and arranged to receive a portion of a zipper slider; and a cover having a pad, wherein at least one of the cover having the pad or the recess portion has a surface sufficient to inhibit migration of particles or organisms past a portion of the barrier upon receipt of the portion of the zipper slider within the recess portion.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1A:
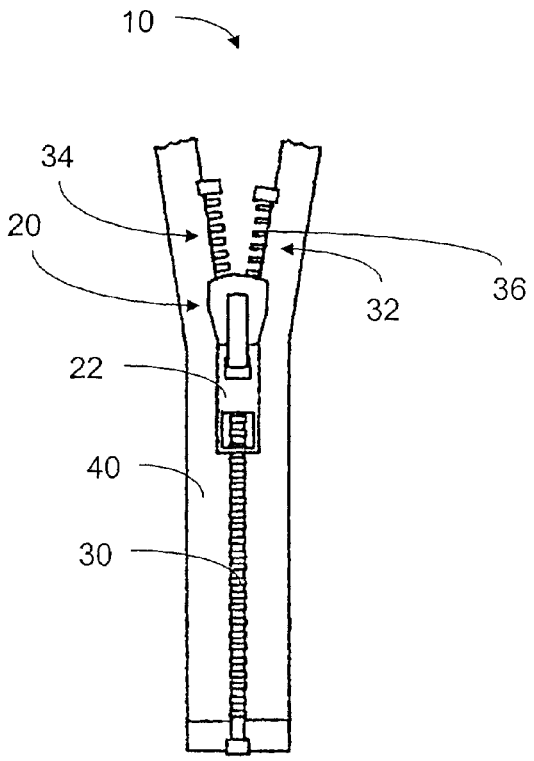
Fig. 1A (Prior Art)
FIG. 1A is an illustration of a conventional zipper assembly.

Aspects discussed herein relate to systems and methods for providing a protective barrier at the end of a pair of linked zipper tracks in a zipper assembly so as to obstruct the migration of small particles and/or organisms from one side of the barrier to the opposite side of the barrier when the zipper assembly is closed. When traditional zippers incorporated on an article (e.g., padding material, mattress/pillow covers, duvets, comforters, etc.) for opening and closing the article are closed as much as possible by a user, a narrow opening at the end of the zipper tracks will almost invariably remain. Such an opening may be large enough (e.g., between about 1 and 10 $mm^2$) for small organisms such as bed bugs and/or dust mites to migrate or crawl through the passageway provided by the narrow opening and move freely from one side of the article to the other. Accordingly, embodiments of zipper assemblies described herein may provide certain advantages by being constructed in a manner that creates an obstruction that blocks or minimizes openings which commonly remain at the end of a closed zipper and, thus, prevents or reduces the migration of particles and/or organisms between opposite sides at the end of the zipper. Therefore, when the zipper is closed, small particles or organisms can be substantially prevented from migrating freely from an interior region of the article to the exterior (or vice versa).

In some embodiments, a barrier includes a base surface that may be attached to a suitable article (e.g., padding material such as fabric for use in a bedding or furniture arrangement). A particular region of the barrier may be suitably adapted to form a connection with a portion of a zipper slider upon closing of the zipper assembly. Such a connection may result in the formation of an obstruction, which can inhibit movement of small objects such as allergens, particles, dust mites, bed bugs and/or other organisms between opposing surfaces of the barrier (and, for example, the fabric) proximate to the zipper slider and at the end of the linked zipper tracks of the zipper assembly.

In some embodiments, the barrier is configured as a plug where a portion of the barrier has a structural feature that engages with a complementary structural portion of a zipper slider to form an obstruction by the resulting connection with the zipper slider.

In some embodiments, the barrier includes a base and a cover that engages with at least a portion of a zipper slider to create a suitable obstruction. For example, the zipper slider may form a flush connection with the base and the cover may enclose the zipper slider and a portion of the zipper tracks to establish one or more obstructions that prevent the migration of particles/organisms past a portion of the barrier (e.g., past a base portion of the barrier or between upper and lower regions of the barrier). Accordingly, placing the zipper assembly in a closed position may result in a suitable connection between an appropriate barrier and a zipper slider that is free of openings greater than a certain amount of surface area. In some embodiments, such a connection between a barrier and a zipper slider may be free of openings that are greater than 20 $mm^2$, greater than 10 $mm^2$, greater than 5 $mm^2$, or greater than 1 $mm^2$ in surface area.

In addition, placement of the zipper assembly in a closed position so as to give rise to a suitable connection between the barrier and zipper slider obstructs migration of particles or organisms of a certain size past a portion of the barrier (e.g., past a base of the barrier, between a lower region and an upper region of the barrier and the article subject to opening and closing by the zipper, etc.). For example, the connection between the barrier and zipper slider may prevent the escape of particles or organisms from underneath the barrier (or base of the barrier) to above the barrier (or base of the barrier), or vice versa. For a barrier that includes a base and a cover, the zipper slider may be pressed against a portion of the base so that the zipper assembly itself is closed, and the cover may be brought over the top of the zipper slider so as to form a press fit or snap fit with the base. Appropriate material (e.g., foam, plastic, polymer, cushioning, padding) may be strategically placed at various regions of the zipper assembly and the barrier, such as at the front and/or rear of the zipper slider. Such an arrangement may form one or more suitable obstructions that prevent the migration of particles or organisms from one side of the barrier to the other. In some embodiments, a suitable connection between the barrier and zipper slider may obstruct migration of particles/organisms between different regions (e.g., upper and lower regions) of the barrier where the particles/organisms are less than 5 mm, less than 1 mm, less than 100 microns, less than 50 microns, less than 10 microns, or less than 1 micron in size.

Figure 1B:
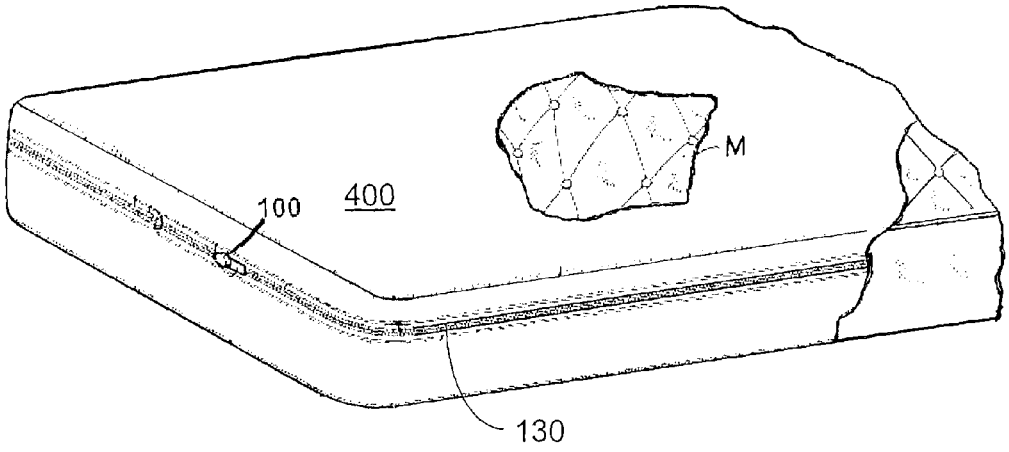
FIG. 1B is a perspective view of a mattress and mattress cover in accordance with an illustrative embodiment.

As discussed, zipper assemblies described herein may be used in association with any suitable mattress cover. FIG. 1B illustrates a mattress cover 400 that provides a protective encasement for a mattress "M." As shown, the mattress cover 400 may include a zipper assembly 100 for use in separating or joining together different fabric portions of the cover. As discussed in more detail further below, mattress covers may include protective assemblies having a zipper and a barrier disposed on a portion of the mattress cover that can engage with a corresponding zipper slider to provide an appropriate obstruction upon connection. Such a connection can provide a suitable obstruction that, for example, effectively blocks bed bugs, dust mites, allergens and/or other small particles from entering and exiting the mattress cover.

Figure 2:
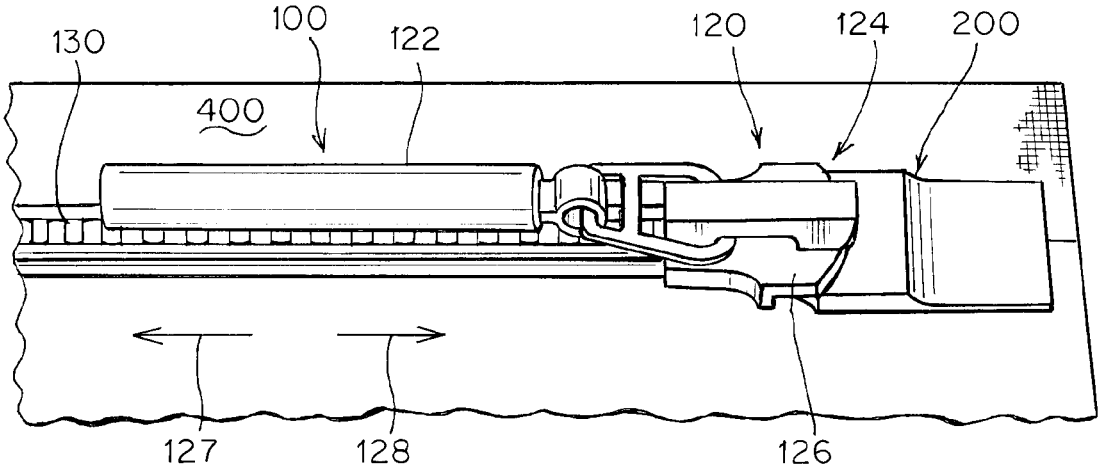
FIG. 2 is a perspective view of a protective assembly for a zipper in accordance with an illustrative embodiment.

FIG. 2 depicts a protective assembly 100 for a zipper that includes a zipper slider 120 placed in slideable engagement with a pair linked zipper tracks 130 so as to separate or join the zipper tracks upon appropriate movement of the slider. The zipper slider includes a pull tab 122 which allows a user to exert an appropriate amount of leverage to manipulate the zipper slider between open and closed positions. The zipper assembly also includes a barrier 200 which is attached to the surface of an article 400 (e.g., mattress cover, bedding material). Each of the zipper tracks includes a plurality of teeth where a set of teeth on one zipper track is engageable with a complementary set of teeth on another zipper track to form a mesh of linked zipper tracks.

The zipper tracks may each be attached to respective portions of the article 400. In various embodiments, portions of the article may include, for example, a fabric suitably attached to respective zipper tracks. The article may be attached to a zipper track by any suitable method, such as for example, an adhesive bond or heat seal.

When the zipper slider is moved in an opening direction 127 (e.g., by a user pulling the tab 122), the linked zipper tracks and respective portions of the article are separated from one another. Alternatively, when the zipper slider is moved in a closing direction 128, the separated zipper tracks and respective portions of the article are brought toward one another to form a tight fit, for example, that is sufficient to prevent movement of bed bugs between the enmeshed teeth through the linked zipper tracks. In some cases, an additional barrier sheet (e.g., plastic, fabric, etc.) may be provided adjacent to the zipper tracks so as to further prevent material from leaking/migrating through linked zipper tracks. As shown in FIG. 2, the zipper assembly is placed in a closed position where the zipper tracks are linked and the zipper slider 120 is in a plugged connected engagement with the barrier 200. The connection between the zipper slider and the barrier effectively obstructs small particles and/or organisms from travel from one surface region of the article to another (e.g., between the lower surface of the article and an upper surface of the article that may or may not extend beyond the barrier). In contrast, in the absence of a suitable connection between the zipper slider and the barrier, a small narrow opening may be present between the zipper slider and the article and/or barrier, providing a passageway that allows particles (e.g., allergens) or organisms (e.g., bed bugs, dust mites, etc.) to migrate.

Figure 3A:
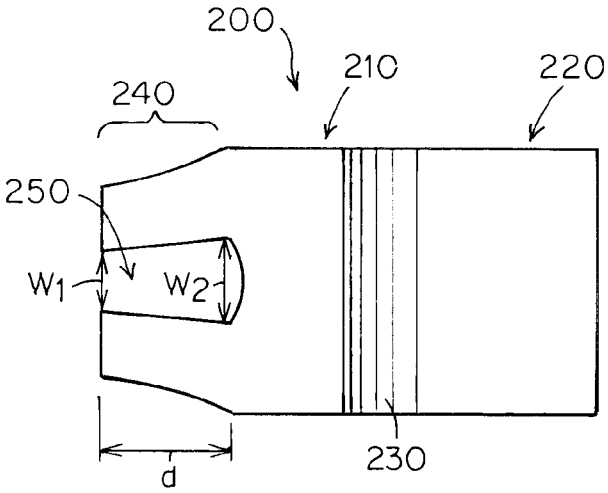
FIG. 3A is a top view of a barrier in accordance with an illustrative embodiment.
Figure 3B:
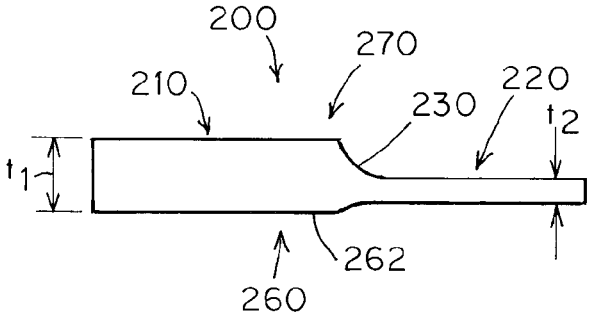
FIG. 3B is a side view of the barrier of FIG. 3A.

FIGS. 3A-3B depict an illustrative embodiment of a barrier 200. In one embodiment, the barrier includes a first portion 210, a second portion 220 and a third portion 230 where the first portion 210 is thicker than the second portion 220 and the third portion 230 connects the first and second portions together. In the embodiment illustrated, the first portion 210 includes a slider connecting region 240 which includes, without limitation, a recess 250 constructed to receive a corresponding connection portion of a zipper slider. Upon suitable connection of the barrier and a zipper slider, an appropriate obstruction is formed so as to prevent migration of small particles and/or organisms between a lower region 260 of the barrier and an upper region 270 of the barrier.

Figure 4A:
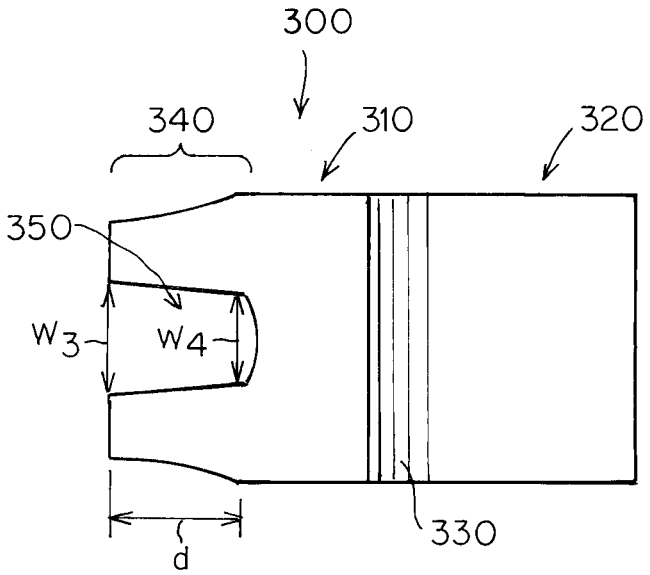
FIG. 4A is a top view of a barrier in accordance with another illustrative embodiment.
Figure 4B:
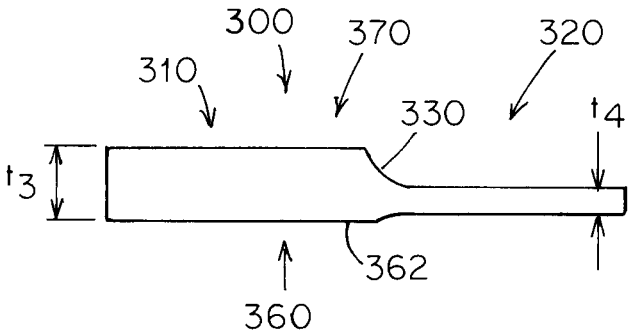
FIG. 4B is a side view of the barrier of FIG. 4A.

FIGS. 4A-4B show another illustrative embodiment of a barrier 300 including a first portion 310, a second portion 320 and a third portion 330, the first portion 310 being thicker than the second portion 320 and the third portion 330 connecting the first and second portions together. Similar to that shown in FIGS. 3A-3B, the first portion 310 includes a slider connecting region 340 having a recess 350 constructed to receive a corresponding connection portion of a zipper slider. When the barrier and zipper slider are suitably connected, an obstruction is formed preventing migration of small particles and/or organisms between a lower region 360 of the barrier and an upper region 370 of the barrier.

Suitable articles described herein may be useful for any purpose where zippers are used, such as for mattress covers, encasements, pillow covers, linen sheets (e.g., duvets, comforters, etc.), padding materials, curtains, drapes, protective coverings (e.g., for swimming pools, tubs, etc.), outdoor equipment (e.g., tents, jackets, etc.) articles of clothing, luggage, carrying cases, suitcases, bags (e.g., gym bags, backpacks, etc.), or any other suitable application. Suitable materials for the articles may include, for example, fabric, plastic, polymer, or any other appropriate material. As described above, portions of padding/bedding material or another appropriate article may be attached to respective zipper tracks and may be suitably joined together or separated depending on whether the zipper slider is manipulated into an opening or closing direction.

The barrier includes a base surface 262, 362 that can be appropriately attached to the article via any suitable fastening arrangement. The barrier can be attached to the article at a suitable location on the article proximate the end of the zipper assembly so that the barrier may be in position to form an obstruction by the connection with the zipper slider when the zipper assembly is closed.

In some embodiments, the barrier is adhesively attached to the article. For example, a suitable adhesive (e.g., resin, epoxy, glue, etc.) may be applied to the base surface of the barrier and/or an appropriate location on the article so as to affix the barrier to the article.

In some embodiments, the barrier is stitched or stapled to the article. For example, the barrier may have holes (not shown in the figures) through which a suitable thread/yarn or staples may pass for attachment of the barrier to a suitable article (e.g., fabric).

In some embodiments, the barrier is attached to the article via a hook and loop fastener arrangement. For example, the base surface of the barrier may include one surface of a hook and loop fastener arrangement (e.g., hooks) and an appropriate location on the article may include a complementary surface of the hook and loop fastener arrangement (e.g., loops).

As mentioned previously, the slider connecting region 240, 340 may include a recess 250, 350 shaped to receive a complementary barrier connection portion of a zipper slider. The barrier connection portion may include the entire zipper slider or a portion of the zipper slider. The recess of a slider connecting region may have any suitable distance "d" for receiving a complementary portion of a zipper slider (e.g., an insert piece of the zipper slider, the entire zipper slider, etc.). In some embodiments, and without limitation, the depth of the recess is between about 0.1 mm and about 50 mm, between about 0.1 mm and about 10 mm, between about 10 mm and about 50 mm, between about 20 mm and about 40 mm, between about 0.5 mm and about 5 mm, or between about 1 mm and about 2 mm.

The recess of a slider connecting region may have any suitable width at various locations along its depth. As the recess of the barrier may be shaped to suitably receive a complementary barrier connection portion (e.g., an insert) of the zipper slider, the width along the recess may appropriately vary. In some embodiments, the width of the recess at the entrance and the width of the recess at a distance "d" from the entrance are unequal.

FIG. 3A illustrates a recess having a shape that is inwardly tapered toward the entrance of the recess where the inner width "$w_2$" at a distance "d" from the entrance is greater than the outer width "$w_1$" at the entrance. In some cases, the recess of the slider connecting region is shaped or has features (e.g., detents, slots) to form a suitable interference fit (e.g., press fit, friction fit) with an insertion area (i.e., barrier connection portion) of the zipper slider. In this regard, a user can draw or push the slider into and out of engagement with the slider connecting region. In some embodiments, the barrier may be made of a material that is flexible to deflect slightly upon entrance of the insertion area into the recess of the barrier while exerting an appropriate pressure back toward the insertion area so as to provide sufficient friction to maintain a tight connection between the zipper slider and the barrier, yet not so great a resistance to prevent wanted removal of the zipper slider from the barrier.

FIG. 4A shows another embodiment of a recess having a shape that is outwardly tapered toward the entrance of the recess where the outer width "$w_3$" at the entrance is greater than the inner width "$w_4$" at a distance d from the entrance. In some embodiments, and without limitation, the width of the recess at any location along the depth of the recess may be between about 0.1 mm and about 10 mm, between about 1 mm and about 5 mm, between about 0.2 mm and about 1.5 mm, or between about 0.5 mm and about 1 mm.

The barrier may include any suitable transition between the first portion 210, 310 and the second portion 220, 320 of the barrier. Although FIGS. 3B and 4B illustrate the barrier to have a third portion 230, 330 that provides a curved transition on both upper and lower surfaces between the first and second portions, other appropriate transition configurations may be implemented. For example, first and second portions may be connected via a stepped transition giving rise to a plateau; or, for example, a straight inclined transition may be provided between the first and second portions of the barrier.

Various portions of the barrier may have any suitable thickness. In some embodiments, and as shown in FIGS. 3B and 4B, the first portion 210, 310 has a thickness "$t_1$", "$t_3$" greater than the second portion 220, 320 which has a thickness "$t_2$", "$t_4$". In some cases, a first portion 210, 310 may be thicker than a second portion 220, 320 so as to afford a greater degree of support upon suitable connection of the zipper slider and the barrier. However, in other instances, a first portion 210, 310 may be thinner than a second portion 220, 320. In some instances, the thickness of the first portion 210, 310 may be suitably designed so that, upon connection of the zipper slider and the barrier, the bottom surface of a complementary region of a corresponding zipper slider rests flush against the top surface of the first portion of the barrier. In some embodiments, and without limitation, the thickness of a first portion 210, 310 or a second portion 220, 320 of the barrier may be between about 0.1 mm and about 10 mm, between about 1 mm and about 5 mm, between about 0.5 mm and about 3 mm, or between about 1 mm and about 2 mm.

Figure 5:
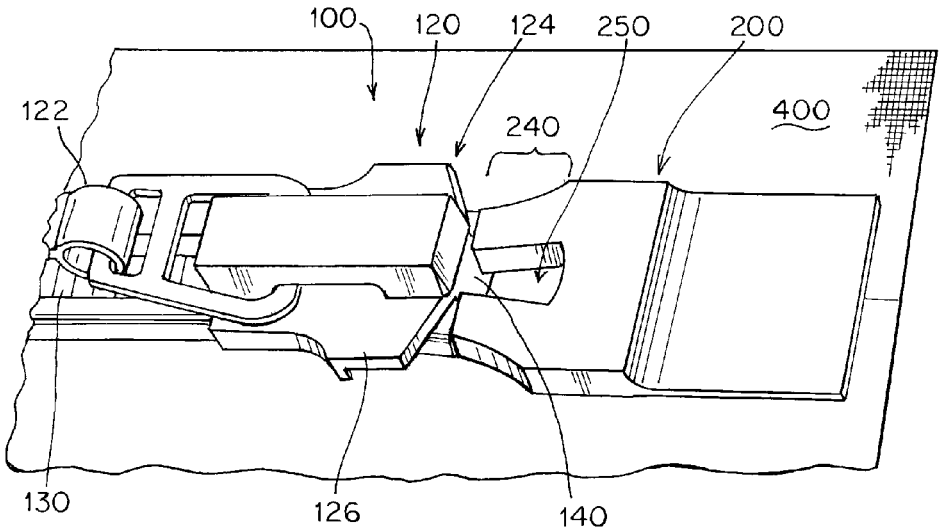
FIG. 5 is a perspective view of a protective assembly for a zipper in accordance with another illustrative embodiment.
Figure 6:
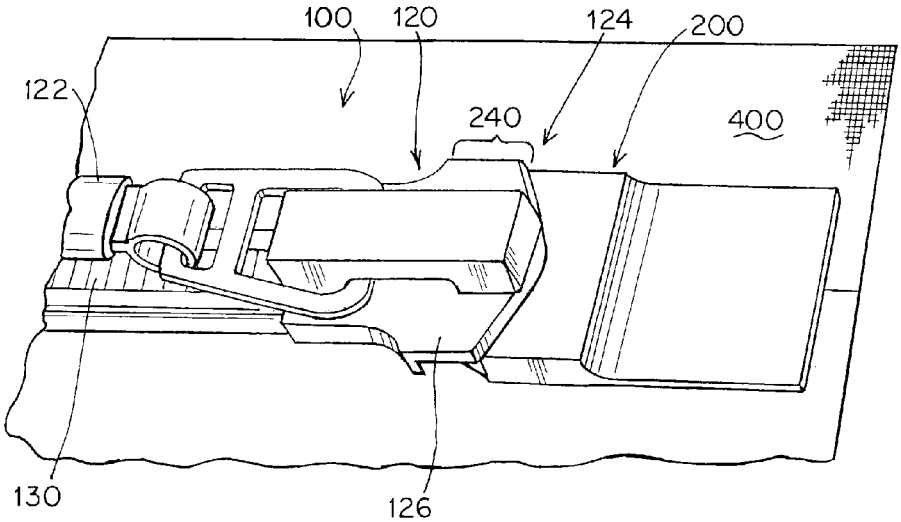
FIG. 6 is a perspective view of the protective assembly for a zipper of FIG. 5 in a closed configuration.

FIGS. 5 and 6 illustrate an embodiment of a protective assembly 100 including a zipper slider 120 and a barrier 200 in a partially open position and a closed position, respectively. The zipper slider includes a front region 124 having a barrier connection portion 140, shown in this embodiment as an insert. The barrier includes a slider connecting region 240 which is provided in this embodiment as a recess 250.

FIG. 5 depicts the zipper assembly to be in a partially open position; that is, the zipper assembly is not quite in a fully closed position. Accordingly, in FIG. 5, the zipper slider and the barrier are not connected in a manner that blocks small particles and/or organisms from migrating between a lower region and an upper region of the barrier. As a result, small objects and/or organisms such as bed bugs or dust mites would be able to move through an aperture between the end of the linked zipper tracks and the barrier and migrate from the lower region of the barrier to the upper region (e.g., through the recess) and back. Thus, bed bugs would be able to freely enter and exit interior and exterior regions of the article (e.g., bedding/furniture cover).

FIG. 6 depicts the protective assembly for the zipper having moved from the partially open position of FIG. 5 to a closed position. As shown, the front region 124 of the zipper slider has been plugged into the slider connecting region 240 of the barrier so as to suitably connect the zipper slider and the barrier. Accordingly, the barrier connection region of the zipper slider, which includes an insert, forms a flush connection with the recess of the slider connecting region of the barrier, forming an appropriate obstruction between the zipper slider and the barrier. The connection between the zipper slider and the barrier covers any narrow openings located at the end of the linked zipper tracks that would otherwise, absent the barrier, not have been covered. In some embodiments, when the zipper assembly is in a closed position where the zipper slider and the barrier are suitably connected, the bottom surfaces of lateral wings 126 of the zipper slider are arranged to be flush with the top surface of the slider connecting region 240 of the barrier. As a result, small particles and/or organisms are effectively blocked from migrating between the lower and upper regions of the barrier. In examples where the article 400 includes a bedding/furniture cover or encasement, when small particles and/or organisms are prevented from migrating between the lower and upper regions of the barrier, such particles and/or organisms are also blocked from entering and exiting the cover or encasement.

It can be appreciated that any other configuration for creating a suitable connection between a zipper slider and a barrier so as to prevent migration of bed bugs/dust mites and/or other small objects from one surface of the barrier to an opposing side may be employed. In some embodiments, rather than the zipper slider having an insert and the barrier having a recess that receives the insert, alternatively, the barrier connection portion of the zipper slider may be shaped to receive a complementary slider connecting portion of the barrier. For example, in a reversed configuration from some of the embodiments described above, the barrier connection portion of the zipper slider may include an appropriately shaped recess and the sliding connecting region of the barrier may include an insert. The insert and the recess may be shaped in complementary fashion so that upon connection, a tight obstruction between the zipper slider and the barrier may be formed for blocking small particle/organism migration.

In some embodiments, and as shown further below, the sliding connecting region of the barrier may have a recess to receive a barrier connection portion of a zipper slider. The barrier connection portion may include the entire zipper slider itself, or a smaller structural portion of the zipper slider. Any other suitable connecting arrangements may be employed between an appropriate zipper slider and barrier.

As previously discussed, even if a zipper assembly and appropriate article is arranged to include a protective barrier attached to the article that may provide suitable blockage of small particles and/or organisms between interior and exterior surfaces of the article that extend beyond the barrier, the zipper may be inadvertently left open. For example, a situation may arise where a user pulls the tab 122 to close the zipper and even though the zipper slider is moved in close proximity to the barrier, a preferred connection or engagement between the zipper slider and the barrier is not made; that is, for some embodiments, the zipper slider is not adequately engaged with or "plugged" into the barrier and a proper obstruction between the zipper slider and the barrier preventing small particle/organism migration from one side of the barrier to an opposing side is absent. For bedding covers that include embodiments of zipper assemblies described herein, because of the opening that invariably remains between the end of the zipper tracks and the zipper slider, a zipper assembly that is not adequately closed will likely fail to prevent bed bug, dust mite, allergen, small particle escape and infiltration, even if only a slight gap exists.

Accordingly, embodiments described herein may also include a notification system that produces a notification signal to a user upon proper connection of the zipper slider and the barrier. In some embodiments, when the slider connecting region of the barrier and the barrier connection portion of the zipper slider are connected so as to form an appropriate obstruction that prevents migration of small particles and/or organisms, a notification member produces an appropriate signal (e.g., audible, visual, tactile, etc.) that informs the user that the zipper is adequately closed and that the zipper slider and barrier are suitably connected.

In various embodiments, the notification member may include a device that produces an audible and/or tactile signal for the user to be notified that the zipper assembly is fully closed and that small particle/organism escape from or infiltration of the article (e.g., bedding cover, bag/luggage, etc.) will not occur. For example, such a notification member may include a snap-fit or press-fit device situated at a suitable region of the barrier and/or the zipper slider. Accordingly, once the zipper is completely closed and the zipper slider is fully engaged with the barrier so as to form a suitable obstruction for small particles/organisms, an audible clicking sound can be heard by the user, informing the user that the zipper assembly is appropriately and sufficiently closed. Or, if the nature of the fit does not produce an audible sound, a user may be able to feel through a tactile sensation (e.g., through an interference fit) that suitable engagement between the zipper slider and the barrier has been established.

Figure 7:
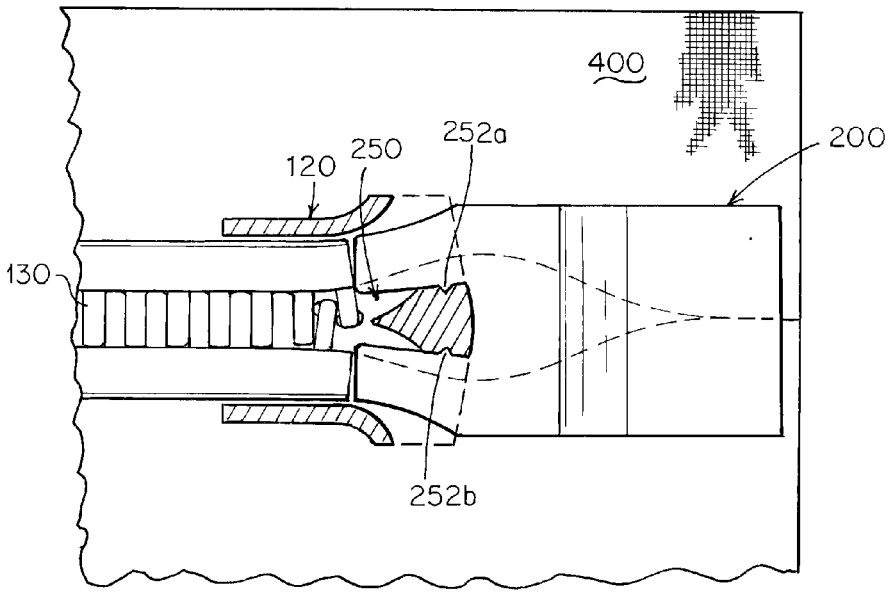
FIG. 7 is a top view of a protective assembly for a zipper in accordance with an illustrative embodiment.

FIG. 7 shows an exemplary embodiment of a barrier 200 where the recess 250 includes detent features 252*a*, 252*b* disposed on opposite sides of the recess. Certain portions of the zipper slider 120 such as the pull tab and the upper surface of the slider are not explicitly shown in FIG. 7 for illustrative purposes. Although not required as such, detent features 252*a*, 252*b* are shown in FIG. 7 to be protrusions that extend from side surfaces of the recess. In some embodiments, the insert of the zipper slider has small indents that are shaped to be complementary to the protrusions of the barrier such that when the insert moves past the protrusions of the recess, an audible click noise or tactile feeling (e.g., due to having overcome an initial mechanical resistance) is produced informing a user that the zipper slider and the barrier are properly connected so as to form a suitable obstruction for small particles/organisms. It can be appreciated that other suitable embodiments may be utilized, such as for example, a recess of a barrier having small indents at appropriate locations of the recess and an insert of a zipper slider with protrusions shaped complementary to the indents.

In some embodiments, the notification member may include a visual indicator that visually informs the user that the zipper assembly is fully and suitably closed such that a suitable obstruction for small particles and organisms is formed. For example, the notification member may include a line or color drawn on an upper surface of the barrier that, if visible, indicates to a user that the zipper has not yet been fully closed and, thus, a proper obstruction to bed bug infiltration has not been formed. When the zipper slider is fully plugged and connected into the barrier, portions of the zipper slider (e.g., lateral wings) will cover the colored portion (e.g., red color, closed symbol) of the upper surface of the barrier providing an indication that a proper connection has been made. In an alternative example, a small button or lever equipped with a spring may be included in the sliding connecting region of the barrier that is connected to a visual indicator located on an upper surface of the barrier and/or the zipper slider. When the zipper assembly is in an opened position, the visual indicator provides a visual display (e.g., red color, open symbol, etc.) showing that the zipper slider and barrier are not fully connected. And when the zipper assembly is placed in a closed position, the visual indicator shows a display (e.g., green color, closed symbol, etc.) notifying the user that the zipper slider and barrier are properly connected. Accordingly, when the user closes the zipper assembly, he/she can check the notification member or simply be informed by the notification member to see whether the zipper assembly has been properly closed to prevent small particle/organism migration between upper and lower surfaces of the barrier and regions of the article extending from the barrier.

Other suitable arrangements may be employed to produce an audible and/or visual notification once the zipper slider and barrier are suitably connected. In some embodiments, a notification system that does not produce an audible or visual signal may be utilized.

In some embodiments, a protective assembly for a zipper includes a housing or cover constructed to cover and/or enclose at least a portion of the barrier and that may be attached to the barrier and/or the article by any suitable method (e.g., using a temporary or permanent fastening arrangement). The housing or cover may also be constructed to cover the front region 124 of the zipper slider when the slider connecting region of the barrier and the barrier connection portion of the zipper slider are connected. In some embodiments, the housing or cover may be constructed to cover the entire zipper slider when the zipper assembly is placed in a closed position. Such a housing or cover may provide added protection for the connection between the zipper slider and barrier, for example, so that it is less likely for the zipper slider to become dislodged from the barrier. The housing may also help to prevent the zipper assembly from becoming partially unzipped, for example, resulting from incidental movement or rustling of the zipper assembly and/or article. In some cases, the housing or cover may further contribute to obstructing migration of particles or organisms between opposing sides of the barrier.

Figure 8:
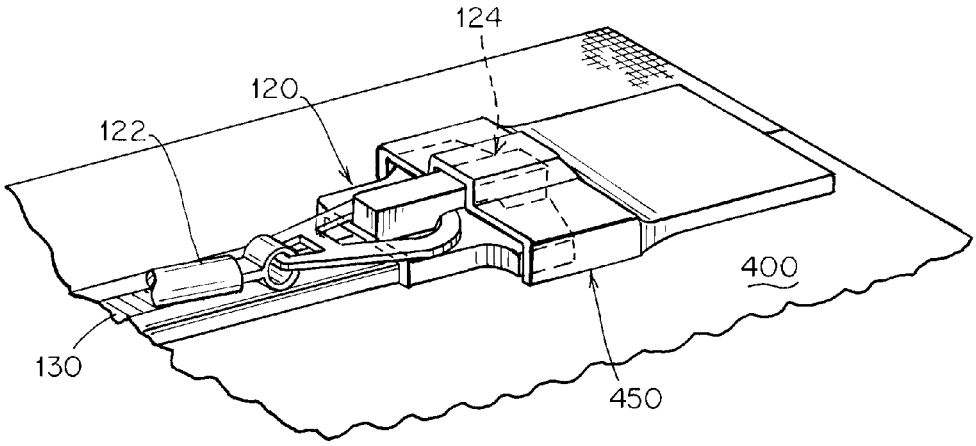
FIG. 8 is a perspective view of a protective assembly for a zipper in accordance with a further illustrative embodiment.

FIG. 8 depicts an illustrative embodiment of a zipper assembly that includes a housing 450. The zipper slider and the barrier are suitably connected and the housing 450 covers both the barrier and a front region 124 of the zipper slider. Accordingly, the housing provides further protection for the connection between the zipper slider and the barrier.

Other suitable arrangements may be employed to ensure that the zipper slider and barrier remain suitably connected after connection. For example, in some embodiments, a snap-fit arrangement may be provided where, upon connection of the zipper slider and the barrier, a snap-fit device works to hold the zipper slider and barrier connection in place. As such, to disconnect the zipper slider and barrier, the user would have to exert more than a nominal amount of effort that would otherwise be typical for manipulating zippers to disconnect the zipper slider and the barrier. In another embodiment, a lock-mechanism may be employed. For example, when the zipper slider and the barrier are suitably connected, the user may actuate an appropriate lock device that holds the plugged connection in place. When the zipper assembly is to be opened, the user would first unlock the device and then separate the zipper slider from the barrier, subsequently pulling apart the zipper tracks. As described above, the barrier connection portion of the zipper slider and the slider connecting region of the barrier may be appropriately shaped to form an interference fit with one another upon connection, providing resistance to the zipper slider and the barrier being disconnected.

Figure 9:
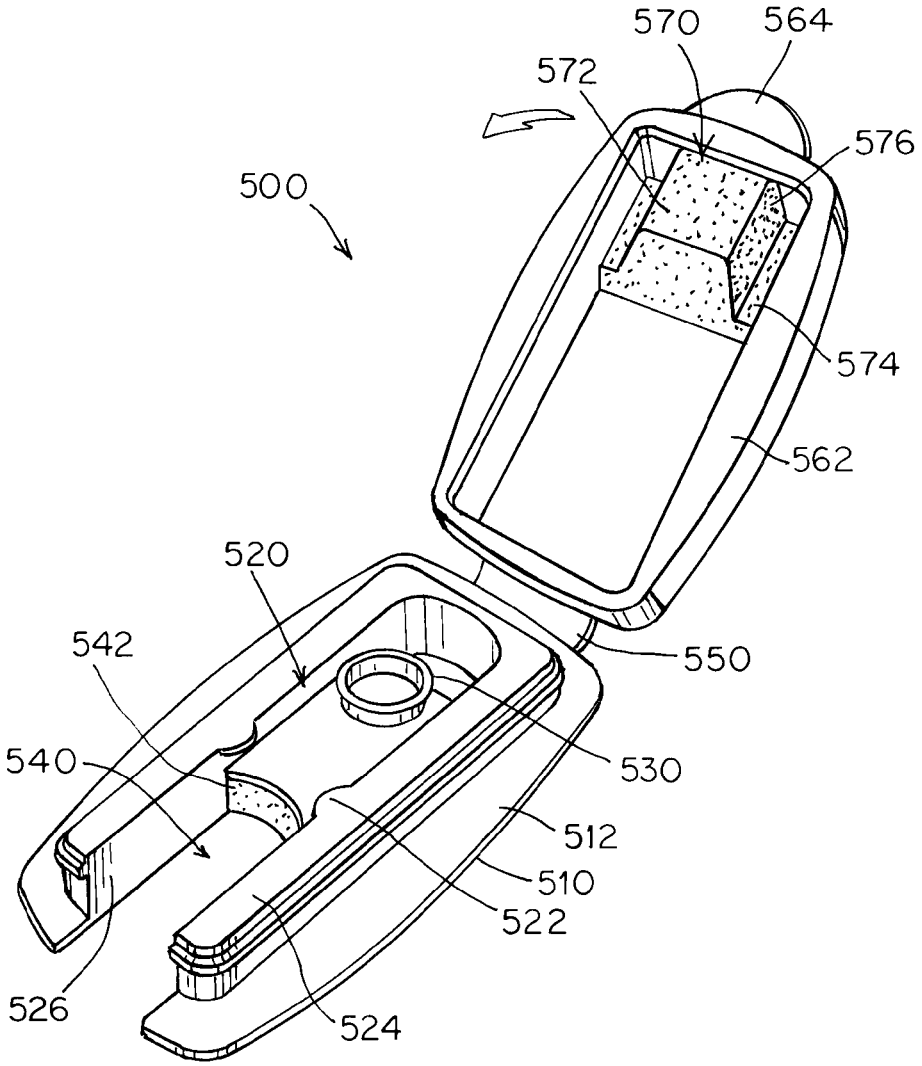
FIG. 9 is a perspective view of a barrier in accordance with an illustrative embodiment.
Figure 10A:
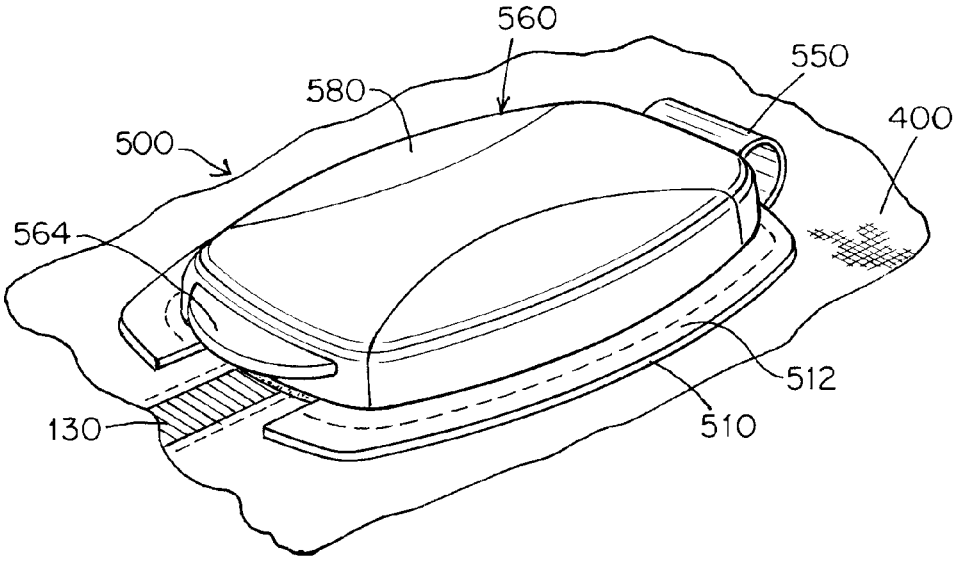
FIGS. 10A-10C are perspective, side and end views, respectively, of the barrier of FIG. 9.
Figure 10B:
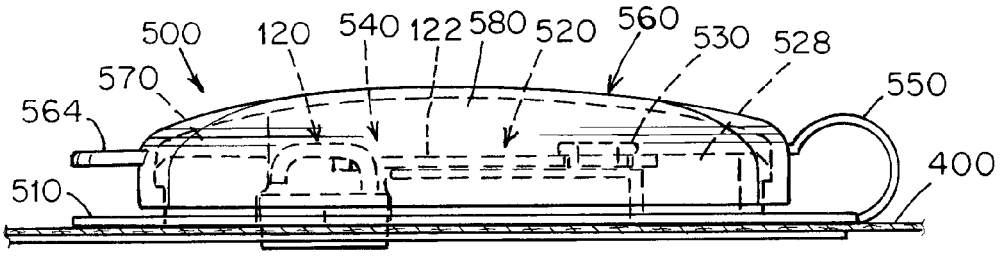
Figure 10C:
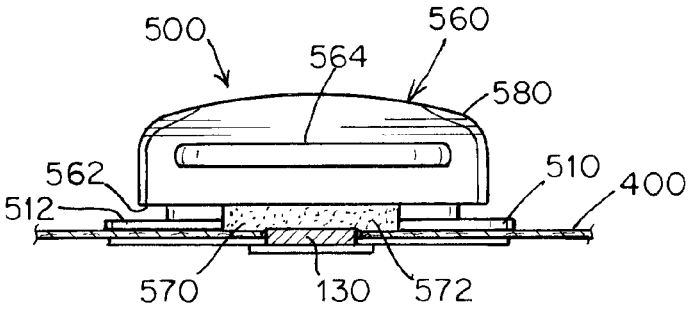
Figure 11:
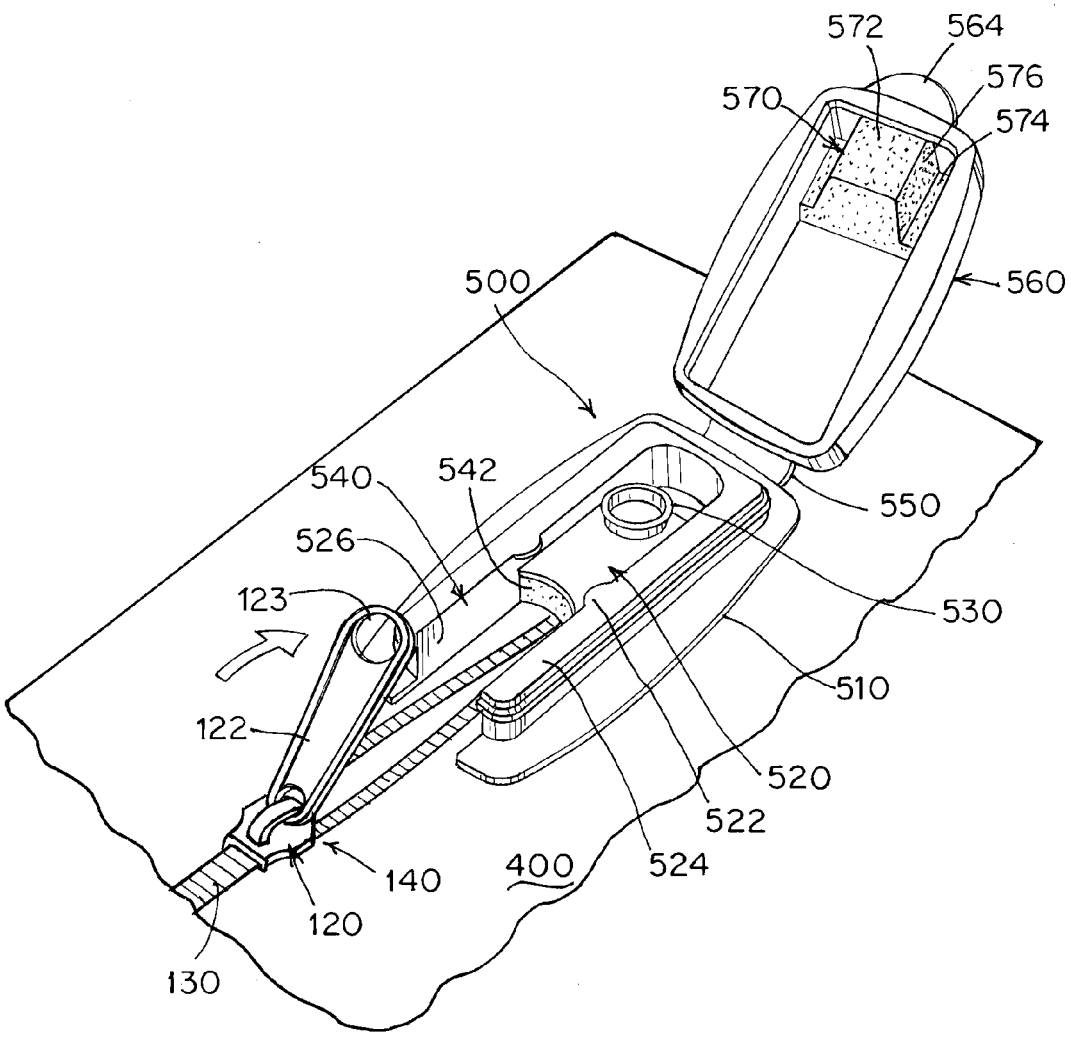
FIG. 11 is a perspective view of a protective assembly for a zipper in accordance with an illustrative embodiment.

FIGS. 9-10C illustrate another embodiment of a barrier 500 that may be used with a zipper assembly and article (e.g., bedding/padding materials) for obstructing the migration of particles and/or organisms, such as allergens, bed bugs or dust mites, when the zipper assembly is placed in a closed position. The barrier may be placed into a coupled arrangement with a zipper slider so as to prevent the infiltration of small particles and/or organisms through regions of the zipper assembly and/or out from the barrier 500. As discussed previously, an opening between the zipper slider and the end of the zipper tracks may still remain regardless of how tightly the zipper slider is drawn to the end of the zipper tracks. For bedding covers (e.g., for mattresses and pillows), such an opening will allow bed bugs and other particles to migrate from the interior of the bedding cover to the exterior, and vice versa. Barrier devices described herein inhibit or block such migration near the opening and/or inhibit migration out of the barrier.

In one embodiment, the barrier 500 includes a base 510 having a bottom surface having a flange that can be attached to any suitable surface, such as an article, for example, bedding materials (e.g., mattress/pillow cover), protective coverings, clothing, outdoor equipment, furniture, baggage, luggage, etc. The flange can be glued or stitched to the article or may be attached using any suitable arrangement or any combination of arrangements.

In one embodiment, the barrier includes a slider connecting region 540, illustrated as a recess or cutout/void in the base 510 within which the zipper slider may reside when the zipper assembly is placed in a closed position. In some embodiments, the shape of the recess may complement the shape of the zipper slider so as to form a generally flush fit that blocks off potential paths through which particles and/or organisms may migrate. While not required, the slider connecting region 540 shown in FIG. 9 includes a slider padding 542 that is formable in a manner where the padding conforms to the front of zipper slider so that no gaps arise when the zipper is coupled to the barrier. The slider padding may include any suitable material, such as a foam (e.g., open or closed cell foam), polymer, cushion, or the like, and is not limited in this regard. For example, the slider padding may include a soft deformable material (e.g., foam, sponge-like material, cushioning) covering over a more rigid plastic portion. Alternatively, the padding may not be used at all and the zipper instead presses up against or conforms generally to the rigid material of the base.

Figure 13:
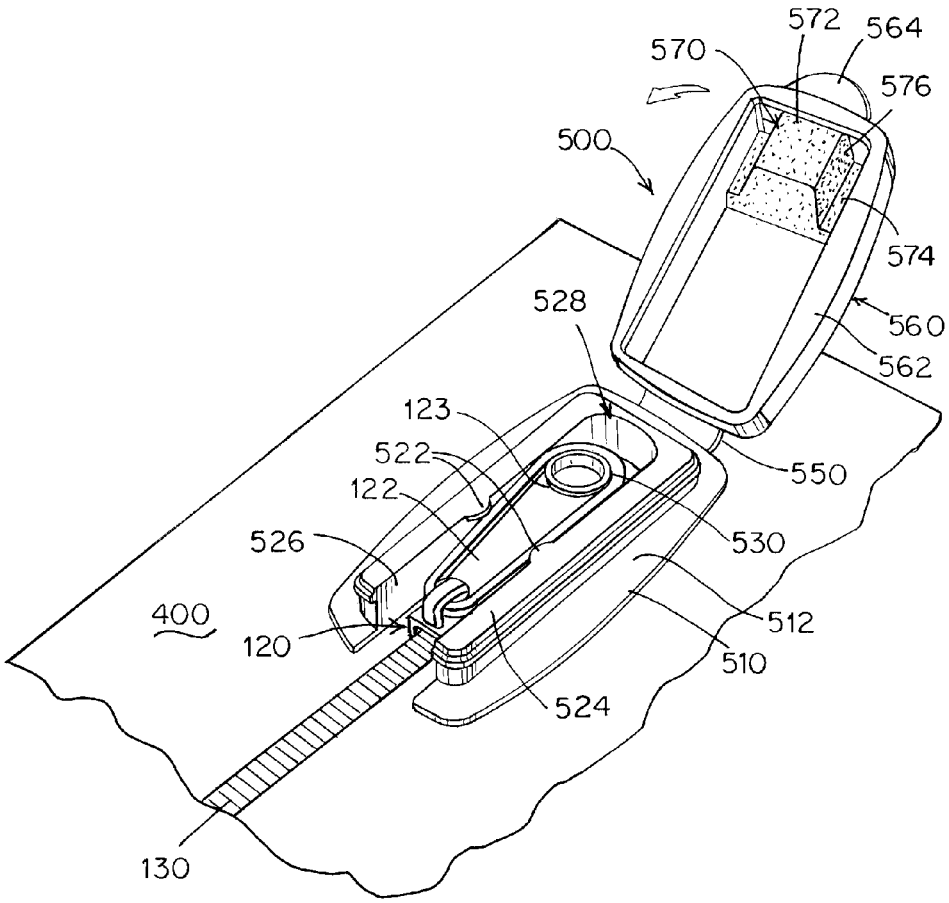
FIG. 13 is another perspective view of the protective assembly for a zipper of FIG. 11 in a closed zipper configuration.

In one embodiment, the base includes a receiving region 520 formed as a cut-away recess shaped to accept a zipper tab. The receiving region 520 incorporates detents 522 that serve as holders to arrest movement of the zipper tab when an interference fit is formed between the zipper tab and the detents (as shown in FIG. 13); hence, the zipper slider is also firmly situated with respect to the barrier. The receiving region may also include a post 530 that may function as a holder for the zipper tab. In this respect, the post may accept an opening of the zipper tab, allowing for the zipper slider and tab to be further coupled with the barrier. Such arrangements may provide for the zipper to remain securely coupled with the barrier so as to maintain the zipper assembly in a closed position, creating a first obstruction of any zipper opening by maintaining the zipper slider in close abutting relationship with the shaped wall or slider padding 542, thereby inhibiting movement of particles and/or organisms past the obstruction.

As discussed previously, it can be appreciated that any suitable structure other than detent(s) or a post may be provided for securing the zipper tab within the receiving region. For example, the receiving region may include a suitable adhesive so that the zipper tab adheres to portions of the receiving region upon contact with the adhesive. Alternatively, a hook (not shown) may be provided for suitably engaging and securing the zipper tab and/or slider within the receiving region. In some embodiments, such a hook may be actuated by a user for appropriately engaging and disengaging the barrier with the zipper tab and/or slider. In other embodiments, a suitable adhesive or hook and loop fasteners may be used to secure the zipper slider or tab within the receiving region.

As shown in FIG. 9, the base 510 is connected to a cover 560 via a connection member 550 such as, in the example shown, an integrally formed hinge. In some instances, the barrier 500 may be closed by a user manipulating the cover 560 along the direction depicted by the curved arrow shown in FIG. 9, relative to the base 510. In some cases, although not necessarily so, the barrier is closed when the surface 562 of the cover 560 is brought into contact with a surface 512 of the base 510. Similarly, the barrier may be closed when the surface 572 comes into contact with the zipper tracks and/or article to which the barrier is affixed; and when the surface 574 contacts the surface 524 of the base. In some cases, a user may grasp tab 564 to facilitate opening and closing of the barrier.

In an embodiment, the cover 560 includes an upper padding 570 having a first padding surface 572, a second padding surface 574 and a third padding surface 576. When the zipper is disposed in the recess of the slider connecting portion 540, the cover 560 may be brought toward the base 510 of the barrier such that the upper padding 570 comes over the zipper slider resulting in the zipper slider and zipper tab being enclosed within the barrier. In this regard, the foam pad 570, when the cover is in the closed position, presses against the zipper tracks, zipper slider and/or base surfaces and provides a second obstruction that blocks egress from the device 500 should migration through the zipper opening occur. It should be appreciated that the invention is not limited to employing both the first and second obstructions and that in some embodiments only the first obstruction is provided, whereas in other embodiments, only the second obstruction is provided.

In some embodiments, the first padding surface 572 is lowered so as to come into contact with the zipper tracks behind the zipper slider (e.g., may be flush contact between the first padding surface 572 and the zipper tracks). In some embodiments, second padding surface 574 comes into contact with upper surface 524 of base 510. In some embodiments, upon closure of the barrier, third padding surface 576 comes into contact with side surfaces 526 of the base. In some cases, upon closing of the barrier, such contact between surfaces of the upper padding may be flush and/or may form a seal-like arrangement between contacting surfaces. Any portion of the upper padding 570 may come into contact with any suitable region of the base; for instance, the padding may be deformable such that portions of the padding may be appropriately bunched together or stretched to suitably contact various regions of the barrier. Accordingly, closure of the barrier so as to bring upper padding 570 around and over the rear side of the zipper slider may further contribute to inhibiting migration of bed bugs from the device.

The upper padding may include any appropriate material, without limitation, such as a foam (e.g., open or closed cell foam), polymer, cushion, or the like. Such material may be repeatedly washed and dried without damage in the ordinary course of use. In some cases, the upper padding 570 may conform to the shape of the zipper slider and/or zipper tab providing a suitable obstruction that prevents particles and/or organisms from passing. The barrier 500 is made of any suitable material such as a polymer or other material that can be subject to washing/drying, repeated opening/closing of hinge, etc. The barrier may include any appropriate material that is generally durable and can withstand regular laundering and consumer use.

FIGS. 10A-10C depict various views of an embodiment where the barrier is closed. In some embodiments, the exterior surface of the cover 560 includes an overmold 580, such as rubber, plastic, polymer, or any other suitable material. The tab 564 and overmold 580 may provide further ease of use for a user in handling the barrier, as well as provide aesthetic qualities. As shown in FIG. 10C, the barrier 500 is disposed above the surface of article 400 (e.g., mattress cover, pillow surface, bag exterior, etc.) and may be attached in any suitable manner, as described above. Also as shown in FIG. 10C, the zipper barrier connection portion 140 of a zipper slider is shown in engagement with a complementary surface, such as of a slider padding 542. Zipper pull tab 122 is engaged on post 530. The cover is closed and foam pad 570 is behind the zipper pull pressing against the zipper tracks.

FIGS. 11-14 illustrate operation of the embodiment shown in FIGS. 9-10C in conjunction with a zipper assembly. The barrier is suitably attached to the article 400 and the zipper tracks 130 to form a path through which the zipper slider 120 may slide into coupling arrangement with the barrier. The zipper slider 120 is depicted on approach toward the barrier 500 along the direction illustrated by the arrow in FIG. 11. At the point illustrated in FIG. 11, the zipper assembly is not quite in a closed position, as the zipper slider 120 is not yet placed in a suitably coupled arrangement with the barrier 500 so as to block small particles and/or organisms from migrating through the zipper opening (e.g., between a lower region and an upper region of the barrier). Accordingly, small objects and/or organisms such as bed bugs or dust mites would be able to move through an aperture between the end of the linked zipper tracks and the barrier from a lower region to an upper region of the barrier and back, from the interior to the exterior of the article (e.g., bedding/padding material) and back, or merely from underneath the base of the barrier to above the base of the barrier and back.

A user may manipulate the zipper slider by grasping the tab 122 at the opening 123 so as to pull the zipper slider toward the barrier. In some embodiments, a barrier connection portion 140 to be coupled with a slider connecting region may include a portion of a zipper slider or the zipper slider itself. Accordingly, the barrier connection portion 140 which, in the embodiment of FIG. 11 includes the entire zipper slider 120, is moved closer toward the slider connecting region 540 along the direction arrow shown. As described previously, a small opening in the zipper tracks may exist regardless of how much a user tries to close the zipper. However, engaging the zipper slider with the barrier brings the zipper assembly to a position where the small opening through which small particles/organisms would otherwise be able to travel is blocked.

Figure 12:
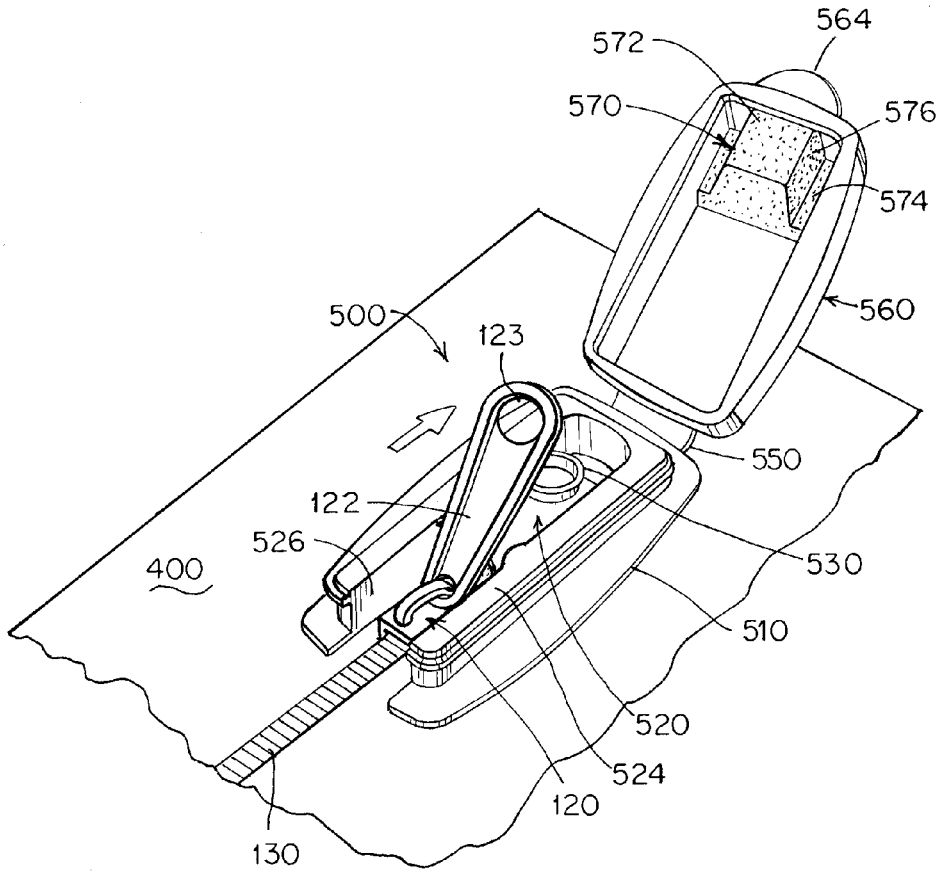
FIG. 12 is a perspective view of the protective assembly for a zipper of FIG. 11 in a closed zipper configuration.

In FIG. 12, the zipper slider 120 is positioned within the recess of the slider connecting region 540 such that the front end of the zipper slider is pushed up flush against the padding 542. At this point, for some embodiments, the zipper assembly is placed in a closed position where migration of small particles and/or organisms is sufficiently obstructed from migrating. In some embodiments, the zipper assembly is placed in a closed position that adequately obstructs ingress and egress of particles and organisms from traversing through this region. In one embodiment, when the barrier is shut closed, i.e., cover 560 comes down over the base 510 such that upper padding 570 suitably engages with surfaces of the base and the underlying zipper tracks where ingress and egress of particles and organisms from entering/exiting the barrier is inhibited.

As illustrated in FIG. 13, the zipper tab 122 is placed into the receiving region 520 of the barrier so as to additionally engage the zipper with the barrier. Accordingly, the zipper tab forms an interference fit with the detents 522, further securing the zipper assembly in the closed position. In some embodiments, in addition to securing the zipper tab within the receiving region, the detents, or any other suitable structure within the barrier, may serve as a notification, such as by providing a notification signal (e.g., tactile and/or audio feedback) informing the user that the interference fit has occurred and that the zipper assembly is in the closed position. For example, pushing the tab into the receiving region may produce an audible clicking sound that may be heard by a user or a snap fit that can be felt by a user as an indication that the zipper tab is secured within the receiving region of the barrier.

In addition, FIG. 13 illustrates the zipper tab to be placed into engagement with the post 530 in a manner where the post enters through the opening 123, further securing the zipper slider and tab in place. As such, even if a force were applied to the zipper assembly in an opening direction that were sufficient to overcome the interference fit structure of the detents, the connection between the opening 123 and the post 530 maintains the zipper slider in place. Accordingly, when opening the zipper assembly, a user would have to pull the zipper tab up from the post 530 before attempting to open the zipper. The coupling between the opening 123 and post 530 may or may not include an interference fit arrangement. It can be appreciated that any suitable method or structure may be used to keep the zipper tab and slider situated with the barrier so that the zipper assembly remains secure so as to form an obstruction to the migration of particles and/or organisms between an interior and exterior of the article 400 past various portions of the barrier (e.g., past a base portion of the barrier, past surfaces 526 of the barrier, past the entire barrier structure itself, etc.).

When the zipper tab 122 rests tightly secured within the receiving region 520 as shown in FIG. 13, a space 528 within the receiving region may remain so that the zipper tab may be suitably disengaged from the receiving region. For example, a user may place his or her finger tip in the space 528 to gain access to pull an edge of the tab with sufficient force to overcome the interference fit connection between the opening 123 and the post 530, if necessary, and bring the tab out of the receiving region. Similar to that shown in FIG. 12, once the zipper tab is disengaged with the receiving region, the zipper slider could then be easily maneuvered back and forth with respect to the barrier between open and closed positions.

FIG. 13 also depicts an arrow indicating the direction in which the cover 560 may be manipulated to close the barrier over and cover the zipper slider and zipper tab. In some embodiments, a user manipulates the cover 560 relative to the base 510 (e.g., grasping the tab, pushing against the exterior surface of the cover, etc.) so that surfaces 512, 562 come into contact with one another. In some embodiments, the cover 560 and base 510 are mutually attached via a snap fit configuration. As explained above, the upper padding 570 may engage with the zipper tracks at the rear side of the zipper slider to provide a seal-like arrangement to further obstruct migration of small particles and/or organisms.

Figure 14:
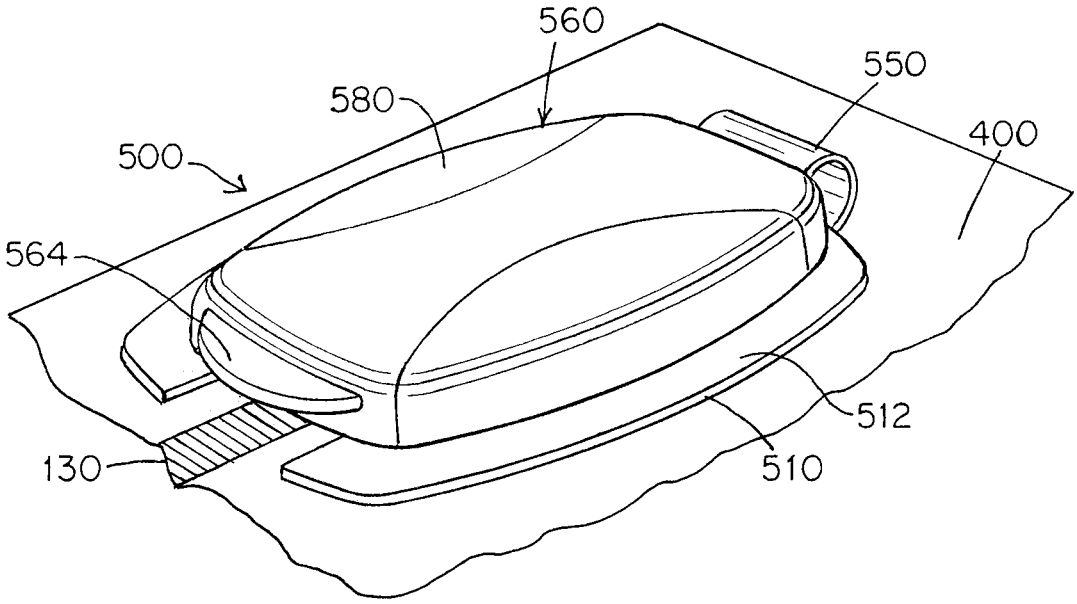
FIG. 14 is a perspective view of the protective assembly for a zipper of FIG. 11 in a covered closed zipper configuration in accordance with an illustrative embodiment.

FIG. 14 illustrates the barrier closed over and enclosing the zipper slider and zipper tab, further securing the zipper assembly in a closed configuration where particles and/or organisms are restricted or prevented from migrating from beneath the barrier, out of the barrier, and back. As such, the upper padding 570 is disposed at the rear of the zipper slider and engages the zipper tracks to block migration of small particles and organisms.

As discussed previously, in an embodiment, the first padding surface 572 resides against the closed zipper tracks located within the barrier, the second padding surface 574 comes into flush contact with upper surfaces 524, and the third padding surface 576 comes into flush contact with side surfaces 526. Accordingly, small particles and/or organisms are prevented from migrating between an interior and an exterior of the article (e.g., bedding/padding material) past surfaces of the barrier and/or zipper slider that are in contact with one another. In some embodiments, small particles and/or organisms are prevented from migrating past a base portion of the barrier. In some embodiments, small particles and/or organisms are prevented from migrating past surfaces between a base and a cover of the barrier that are in contact as well as surfaces between the zipper slider and the barrier that are in contact.

FIGS. 15A-18B illustrate operation of another embodiment of a barrier 500. As in other embodiments, the barrier may be used with a zipper assembly and appropriate article (e.g., bedding/padding materials) for obstructing the migration of particles and/or organisms from one side of the barrier to an opposite side when the zipper assembly is placed in a closed position. There are similarities in this embodiment with respect to that shown in FIGS. 9-14, yet there are also a number of slight differences which are non-limiting in nature. The base 510 includes a slider connecting region 540, provided as a recess or cutout space within which the zipper slider may reside when the zipper assembly is placed in a closed position. During operation, a user may pull the zipper tab 123 toward the barrier along the direction indicated by the arrow shown in FIG. 15A.

Figure 15A:
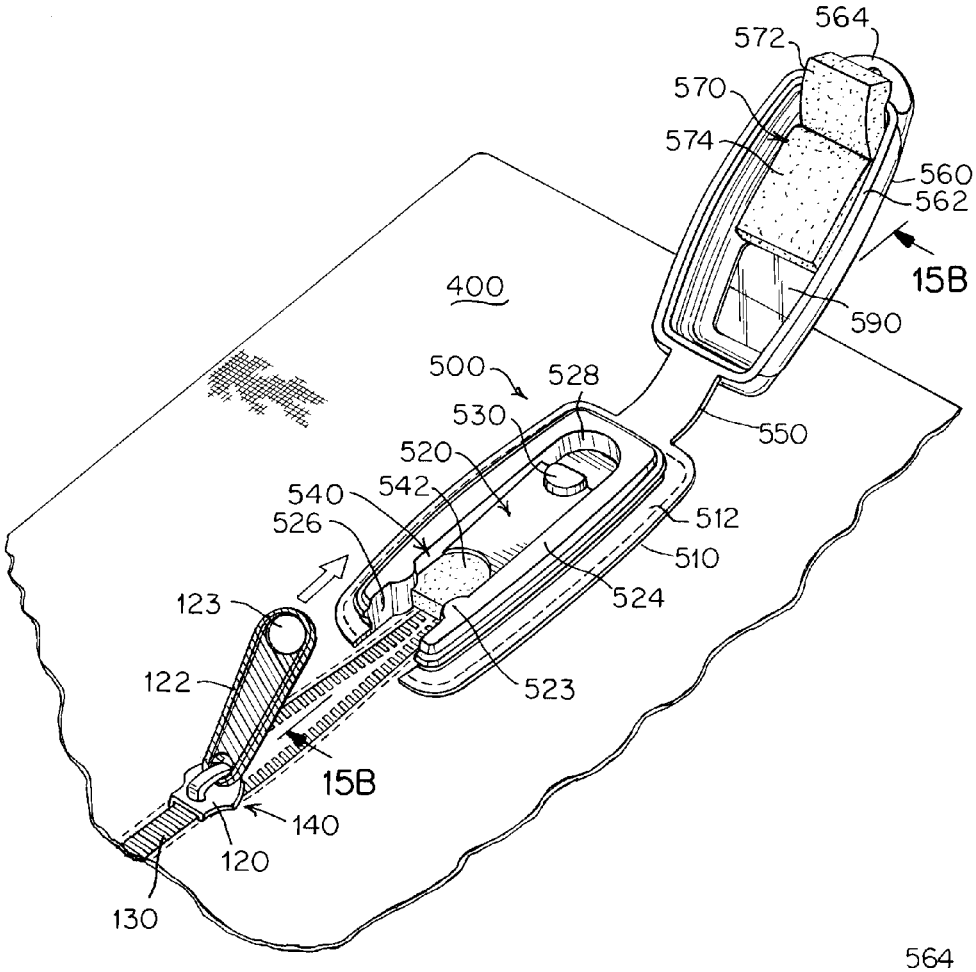
FIGS. 15A-15B are perspective and cross-sectional views of a protective assembly for a zipper in accordance with another illustrative embodiment.
Figure 15B:
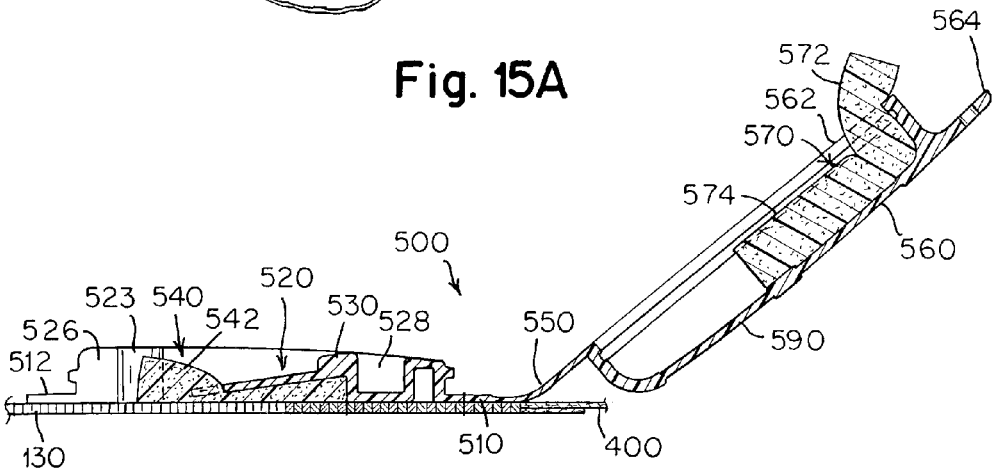

As shown in FIGS. 15A-15B, the slider padding 542 of the slider connection region 540 extends into the recess and may be deformable such that when the zipper slider pressed up against the padding, the padding conforms to the shape of the front portion of the zipper slider. When pressed against one another, a snug fit is formed between the slider and the padding so as to obstruct migration of small particles/organisms through the recess between the slider and the padding.

The slider connecting region 540 includes detents 523 that may resist movement of the zipper slider by virtue of their protrusion into the slider as the slider moves relative to the detents, forward or backward through the connecting region 540. That is, for some embodiments, to move the zipper slider past the detents for closing the zipper assembly, a user may need to pull the zipper tab or push the zipper slider with slightly more force than would otherwise be necessary for moving the slider along other regions of the zipper tracks.

Figure 16:
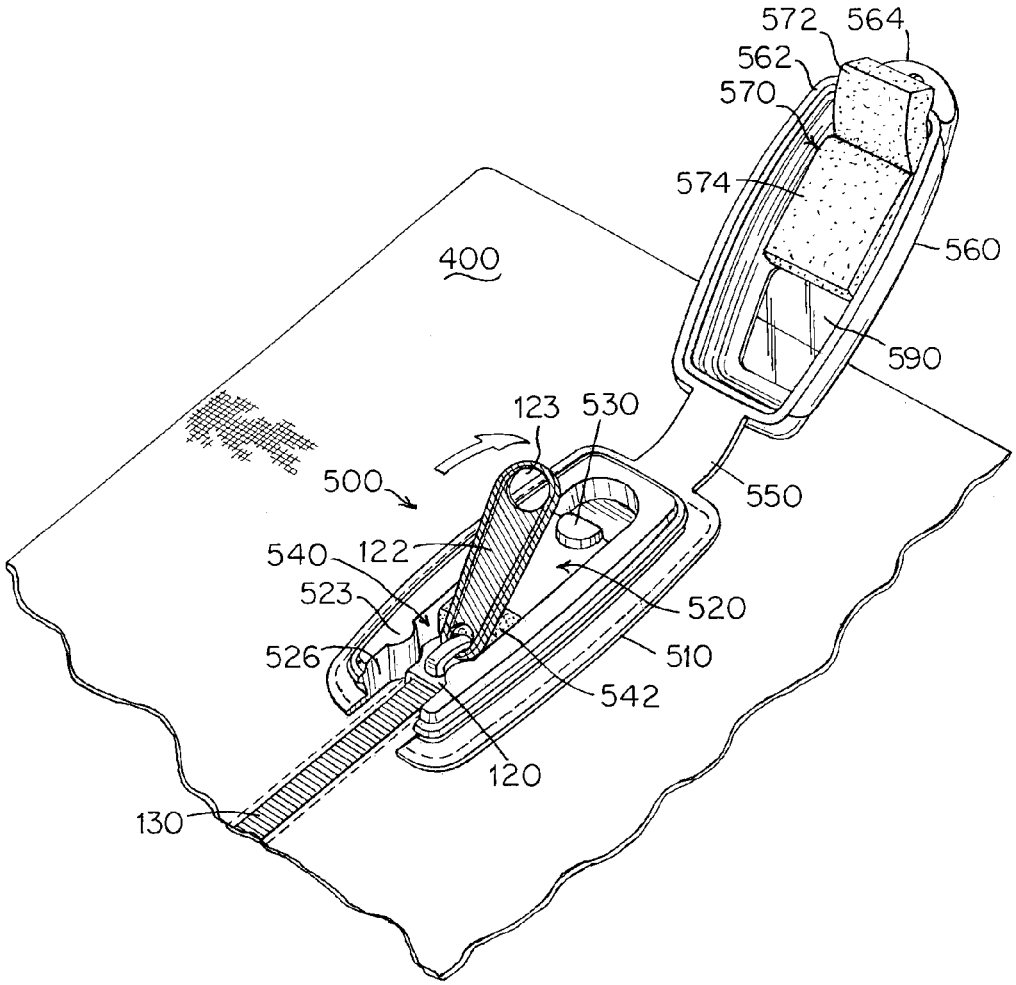
FIG. 16 is a perspective view of the protective assembly for a zipper of FIGS. 15A-15B in a closed zipper configuration.
Figure 17:
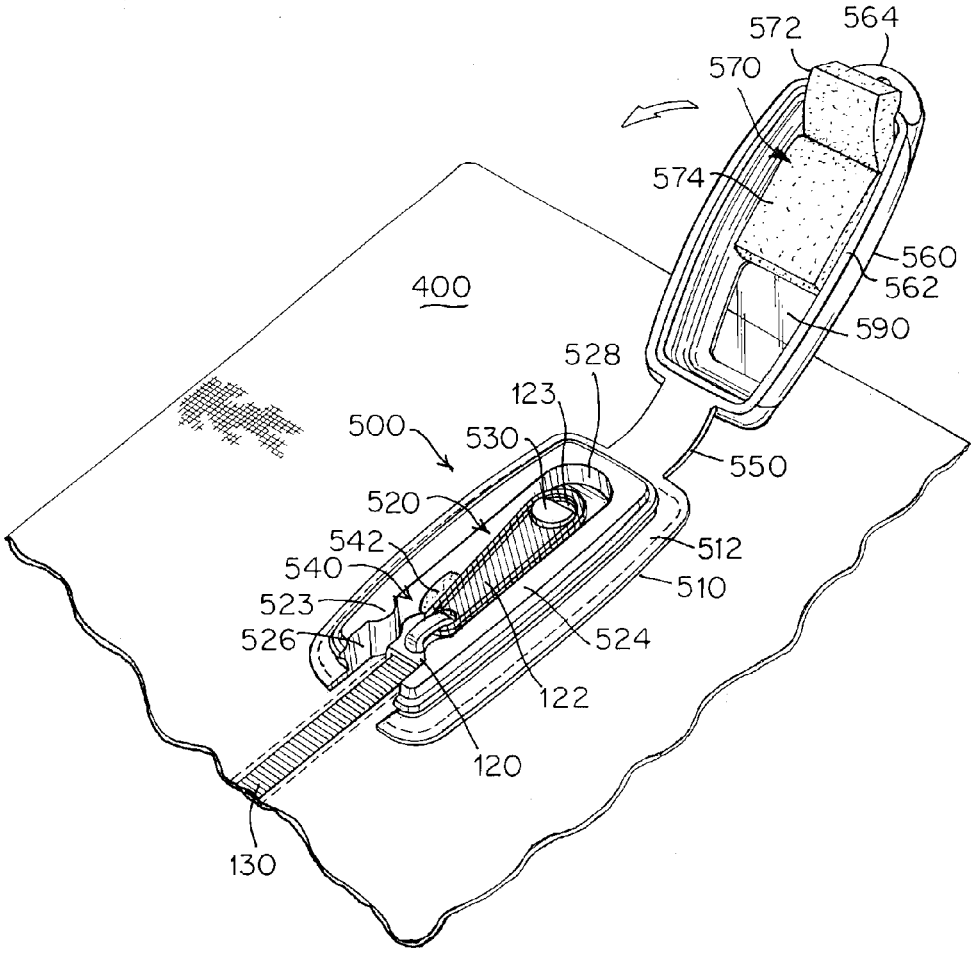
FIG. 17 is another perspective view of the protective assembly for a zipper of FIGS. 15A-15B in a closed zipper configuration.

FIG. 16 illustrates the zipper slider pressed up against the padding 542 where some extra effort may have been exerted for the slider to move past the detents 523. Once the zipper slider moves into the connecting region 540 past the detents 523 and is placed into a fully closed position, the snug fit is formed between the slider and the padding of the barrier. The detents may ensure that the zipper is securely positioned against the padding by providing resistance from inadvertent movement of the zipper back out of the barrier. Accordingly, when opening the zipper, to bring the zipper slider out of engagement with the barrier, a similar threshold of mechanical resistance that is encountered in closing the zipper would also need to be overcome for moving the zipper slider back past the detents.

The zipper tab may be placed into engagement with the post 530 similarly to that shown and described for FIG. 13. In accordance with the arrow shown in FIG. 16, the zipper tab 122 may optionally be placed within the receiving region 520 and rest secured where the tab remains substantially parallel with respect to the base of the barrier.

The upper padding 570 of the cover 560 extends outside the boundary defined by the surface 562. For instance, a portion of the padding 570 is adhered to the inner surface of the cover and another portion of the padding spills out past edges of the cover extending toward the tab 564. When the zipper tracks are closed, the cover 560 may be brought toward the base 510 in the direction indicated by the arrow shown in FIG. 17 so as to close the barrier. In some embodiments, the cover 560 and the base 510 are suitably fastened to one another (e.g., interference fit, snap fit).

Figure 18A:
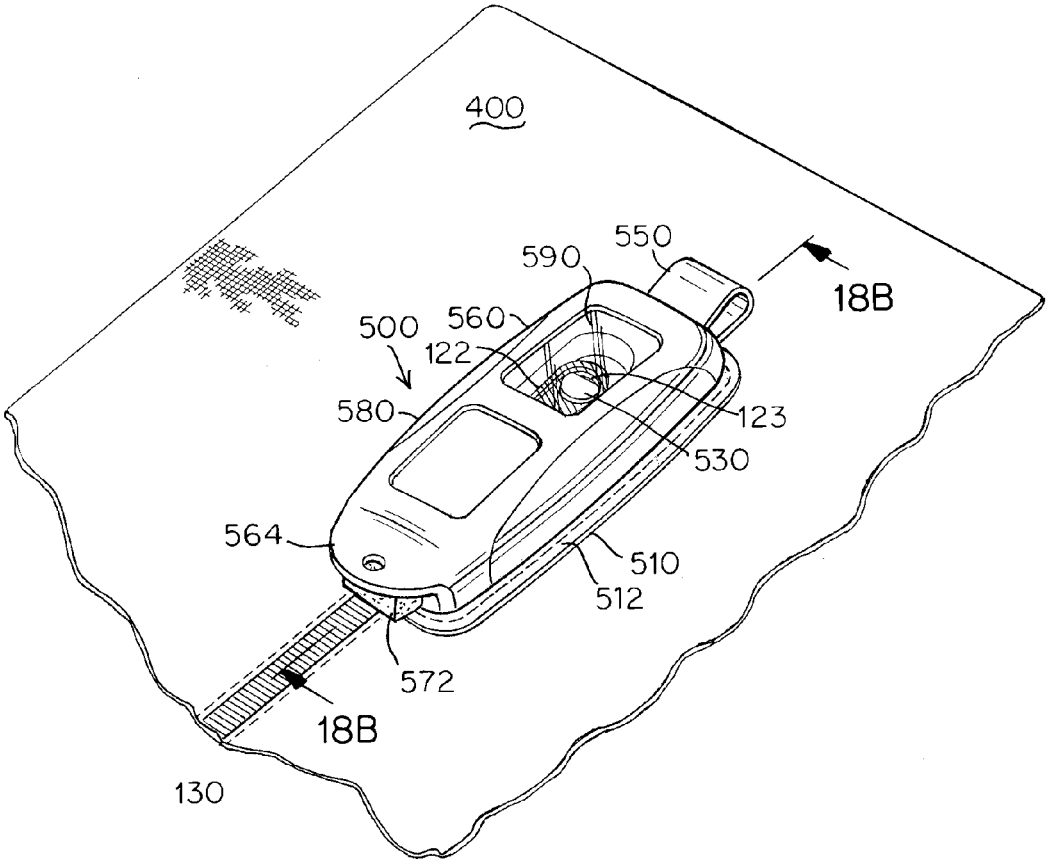
FIGS. 18A-18B are perspective and cross-sectional views of the protective assembly for a zipper of FIGS. 15A-15B in a covered closed zipper configuration in accordance with an illustrative embodiment.
Figure 18B:
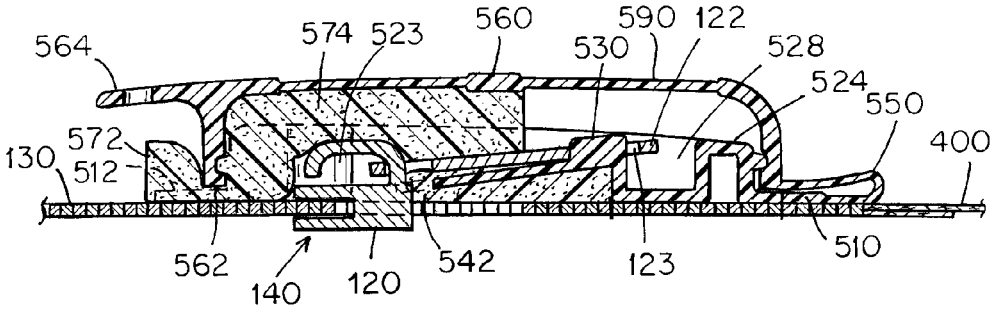

FIGS. 18A-18B illustrate a closed barrier where the cover encloses the zipper slider and tab. When the barrier is closed, the padding 570 substantially surrounds the rear of the zipper slider and presses against the zipper tracks. For example, a first padding surface 572 that extends outside the cover and toward the cover tab 564 may be pressed down against the zipper tracks and a second padding surface 574 that remains within the space enclosed by the cover may be pressed down against the zipper slider and tab. Accordingly, the padding 570 creates an additional obstruction that blocks migration of small particles/organisms past the barrier 500. In some embodiments, and as shown in the figures, when the barrier is closed, the zipper tab 122 is appropriately placed in a resting position within the receiving region 520 and enclosed by the cover. Accordingly, when placed in this resting position, the zipper tab 122 does not interfere with the obstruction formed by the padding 570 along the zipper tracks.

Further, as discussed above, an appropriate indication may be provided so as to notify an inspector that the barrier is properly installed in creating the suitable obstruction(s). Such an indication will allow a person to determine with confidence that small organisms or particles are prevented from migrating from the space enclosed by the article (e.g., bedding, padding, bag) to the exterior surface of the article and outside the barrier, or vice versa. If, for example, someone who is inspecting whether the zipper assembly and the barrier are both properly closed and installed is not able to receive notification of such an indication, then the zipper assembly and/or barrier would have to be further manipulated to so that the appropriate obstruction(s) are formed.

In some embodiments, the cover has a window 590 that is transparent or translucent, allowing for an inspector to view through the window 590 whether the zipper tab is appropriately placed. FIG. 18A illustrates a zipper and barrier that are properly closed where the tab 122 is visibly shown through the window 590. It can be appreciated that the window may be a separate element or the material itself that forms the device. For example, the cover 560 may be comprised of a transparent or translucent material where the window and the cover are one in the same. That is, in some embodiments, the window is an integral part of the cover. Alternatively, in other embodiments, the window is formed as a separate material apart from the cover and joined with other components to form the cover through a suitable manufacturing process.

Further, the zipper tab is optionally colored in a manner that provides a visual contrast with the rest of the device and allows the inspector to easily see whether the zipper tab is suitably in place (e.g., zipper tab may be bright green, red, blue, yellow, etc.). For example, an inspector may have a need to quickly determine whether the barrier is appropriately installed for a large number of bedding encasements (or other appropriate articles). By including a window in the cover and a visually contrasting zipper tab, an inspector can quickly peer through the window and see whether the zipper tab is suitably placed in its appropriate resting position. Accordingly, the inspector can confidently move on to the next article knowing that beg bugs or dust mites will be prevented from migration from the interior to the exterior of the encasement, and back.

It is to be understood that the invention is not limited in its application to the details of construction and the arrangement of components set forth in the following description or illustrated in the drawings. Other embodiments and manners of carrying out the invention are possible. The phraseology and terminology used herein is for the purpose of description and should not be regarded as limiting. The use of "including," "comprising," or "having" and variations thereof is meant to encompass the items listed thereafter and equivalents thereof as well as additional items.

Having thus described various illustrative embodiments and aspects thereof, modifications and alterations may be apparent to those of skill in the art. Such modifications and alterations are intended to be included in this disclosure, which is for the purpose of illustration only, and is not intended to be limiting. The scope of the invention should be determined from proper construction of the appended claims, and their equivalents.

What is claimed is:

1. A barrier comprising:

a base attachable to the surface of an article that includes a zipper with zipper tracks and a zipper slider that cooperates with the zipper tracks to open and close the zipper, the base having a slider connecting region configured to receive the zipper slider;

a cover attached to the base and movable from an open position to receive the zipper slider in the slider connecting region, to a closed position to enclose the zipper slider received in the slider connection region; and a slider padding located on the base and extending across the slider connecting region from a first side of the base to a second side of the base, the first side of the base to be located on a first side of the zipper tracks and the second side of the base to be located on a second side of the zipper tracks when the base is attached to the surface of the article, the slider padding to extend across and overlie a portion of the zipper tracks at the slider connecting region, the slider padding constructed and arranged to engage with the zipper slider and to form an obstruction that prevents migration of particles or organisms past a portion of the barrier when the cover is in the open position and the zipper slider is received in the slider connecting region, wherein a material of the slider padding is softer than a material of the base.

2. The barrier of claim 1, wherein the slider connecting region comprises at least one detent constructed to provide mechanical resistance to the zipper slider.

3. The barrier of claim 1, wherein the slider connecting region comprises a recess constructed to receive the zipper slider.

4. The barrier of claim 1, further comprising an upper padding located on and moveable with the cover and constructed and arranged to abut the zipper slider upon enclosing the zipper slider with the cover in the closed position.

5. The barrier of claim 1, wherein the receiving region and/or the cover is configured to provide a notification that the obstruction is formed.

6. The barrier of claim 5, wherein the notification comprises a visible notification.

7. The barrier of claim 1, wherein a portion of the slider connecting region is constructed to form an interference fit with the zipper slider.

8. The barrier of claim 1, wherein the obstruction prevents migration of particles or organisms less than 10 microns in size past the portion of the barrier.

9. A protective assembly, comprising:

an article having a surface;

a pair of zipper tracks including a first plurality of teeth engageable with a second plurality of teeth, the pair of zipper tracks attached to the article;

a zipper slider cooperating with the pair of zipper tracks to manipulate the pair of zipper tracks between an open position and a closed position, the zipper slider having a first height; and a barrier including a base attached to and more rigid than the surface of the article, the base having a slider connecting region constructed and arranged to receive the zipper slider when the zipper tracks are in the closed position and to obstruct migration of particles or organisms past a portion of the barrier, the slider connecting region including first and second side surfaces located along opposing sides of the zipper track, the first and second side surfaces having a second height that is greater than the first height of the zipper slider so that the first and second side surfaces extend above the zipper slider when the zipper slider is received in the slider connecting region, and the barrier including a cover attached to the base and moveable from an open position to receive the zipper slider in the slider connecting region, to a closed position to enclose the zipper slider received in the slider connecting region.

10. The protective assembly of claim 9, wherein a portion of the slider connecting region is constructed to provide mechanical resistance to the zipper slider.

11. The protective assembly of claim 9, wherein connection of the zipper slider and the slider connecting region of the barrier forms an obstruction in a mattress or pillow encasement to block entry and exit of particles or organisms to and from the mattress or pillow encasement.

12. The protective assembly of claim 9, wherein placement of the zipper tracks in the closed position obstructs migration of particles or organisms between a lower region and an upper region of the barrier.

13. A protective assembly, comprising:

an article having a surface;

a barrier including a base attached to the surface of the article;

a pair of zipper tracks including a first plurality of teeth engageable with a second plurality of teeth, the pair of zipper tracks attached to the article;

a zipper slider cooperating with the pair of zipper tracks to manipulate the pair of zipper tracks between an open position and a closed position, a zipper tab attached to and extending from the zipper slider for pulling the zipper slider along the pair of zipper tracks, wherein the base includes a slider connecting region constructed and arranged to receive the zipper slider when the zipper tracks are in the closed position, the slider connecting region having an open end to receive the zipper slider and a closed end opposite the open end; and a zipper tab receiving region located on the base, the zipper tab receiving region including a zipper tab retainer to securely engage the zipper tab within the zipper tab receiving region, wherein the zipper tab retainer is located beyond the closed end of the slider connecting region in a direction away from the open end of the slider connecting region to position the zipper tab beyond the closed end when the zipper tab is secured in the zipper tab receiving region, and wherein the zipper tab receiving region is constructed and arranged to produce an audible sound and/or a tactile snap fit when the zipper tab is pushed into engagement with the zipper tab retainer as an indication that the zipper tab is secured within the zipper tab receiving region, wherein the barrier includes a cover attached to the base and movable from an open position to receive the zipper slider in the slider connecting region, to a closed position to enclose the zipper slider received in the slider connecting region.

14. The protective assembly of claim 13, wherein the audible sound is indicative of a snap fit produced by the zipper tab and the zipper tab receiving region.

15. The protective assembly of claim 13, wherein the zipper tab receiving region includes detents configured to form an interference fit with the zipper tab.

16. The protective assembly of claim 13, wherein the slider connecting region is constructed and arranged to obstruct migration of particles or organisms past a portion of the barrier when the zipper slider is received in the slider connecting region.

17. The barrier of claim 1, further comprising a zipper tab retainer located on the base and constructed and arranged to receive at least a portion of a zipper tab and secure the zipper tab to the base, the zipper tab attached to and extending from the zipper slider.

18. The barrier of claim 17, wherein the zipper tab retainer includes a post constructed and arranged to engage an opening of the zipper tab.

19. The protective assembly of claim 9, wherein the barrier further includes a post constructed and arranged to engage an opening of a zipper tab, the a zipper tab attached to and extending from the zipper slider for pulling the zipper slider along the pair of zipper tracks.

20. The protective assembly of claim 13, wherein the zipper tab retainer includes a post constructed and arranged to engage an opening of the zipper tab.

21. A barrier comprising:

a base configured to be attached to an article, the base having a receiving region constructed and arranged to receive a zipper slider having a zipper tab; and a cover, at least a portion of which is transparent or translucent, the cover attached to the base and movable between an open position and a closed position to enclose the zipper slider and the zipper tab received in the receiving region, wherein the transparent or translucent portion is positioned on the cover so as to overlie at least a portion of the zipper tab when the zipper slider and the zipper tab are received in the receiving region and the cover is in the closed position such that the portion of the zipper slider is visible through the transparent or translucent portion of the cover.

22. The barrier of claim 21, wherein the cover includes a pad, and a material of the pad is softer than a material of the base.

23. The barrier of claim 22, wherein the pad is configured to abut a pair of zipper tracks when the cover is in the closed position.

24. The barrier of claim 21, in combination with a mattress cover.

25. The barrier of claim 21, wherein the receiving region includes a post constructed and arranged to engage an opening of the zipper tab to secure the zipper tab to the base.

* * * * *